US010845172B2

(12) United States Patent
Moreno et al.

(10) Patent No.: US 10,845,172 B2
(45) Date of Patent: Nov. 24, 2020

(54) MID-BODY MARKING PROJECTILE

(71) Applicant: NOSTROMO, LLC, Kennebunk, ME (US)

(72) Inventors: Marcelo Moreno, São Caetano Do Sul (BR); Nicolas Horacio Bruno, Cordoba (AR)

(73) Assignee: NOSTROMO, LLC, Kennebunk, ME (US)

( * ) Notice: Subject to any disclaimer, the term of this patent is extended or adjusted under 35 U.S.C. 154(b) by 47 days.

(21) Appl. No.: 16/111,525

(22) Filed: Aug. 24, 2018

(65) Prior Publication Data

US 2019/0072370 A1 Mar. 7, 2019

Related U.S. Application Data

(60) Provisional application No. 62/549,596, filed on Aug. 24, 2017.

(51) Int. Cl.

| | |
|---|---|
| ***F42B 12/40*** | (2006.01) |
| ***F42B 12/50*** | (2006.01) |
| ***F42B 8/16*** | (2006.01) |

(52) U.S. Cl.

CPC ..... *F42B 12/40* (2013.01); *F42B 8/16* (2013.01); *F42B 12/50* (2013.01)

(58) Field of Classification Search

CPC .. F42B 12/40; F42B 12/20; F42B 8/14; F42B 8/16; F42B 12/50

USPC ..... 102/502, 513, 529, 498

See application file for complete search history.

(56) References Cited

U.S. PATENT DOCUMENTS

| | | | | |
|---|---|---|---|---|
| 2,112,758 A * | 3/1938 | Blacker | ..... | F42B 12/50 102/517 |
| 2,986,091 A * | 5/1961 | Ferguson | ..... | F42B 8/16 102/529 |
| 3,170,405 A * | 2/1965 | Jungermann | ..... | F42B 8/14 102/529 |
| 3,732,821 A | 5/1973 | Royer | | |

(Continued)

FOREIGN PATENT DOCUMENTS

| | | |
|---|---|---|
| EP | 2549221 A2 | 1/2013 |
| EP | 2834589 B1 | 3/2016 |

(Continued)

OTHER PUBLICATIONS

United States Statutory Invention Registration No. H114, R. Quintavalle; "Practice Rojectile Assembly", Published Aug. 5, 1986.

(Continued)

*Primary Examiner* — James S Bergin
(74) *Attorney, Agent, or Firm* — Robert W. Morris; Eckert Seamans Cherin & Mellott, LLC

(57) ABSTRACT

A cartridge incorporating a projectile assembly, the projectile assembly having a base, mid body component housing a marking powder and lighter metallic nose cap. The projectile's mid-body component undergoes wall failure at impact, the wall failure is induced as forward momentum of the base and other residual forces act to expel the marking powder from the projectile, the manner of ejection suspending a low density material with contrast dye, in the vicinity of the impact, providing a gunner with visual cue in regard to a projectile's impact location.

16 Claims, 39 Drawing Sheets

(56) References Cited

U.S. PATENT DOCUMENTS

| | | | | |
|---|---|---|---|---|
| 3,983,817 | A * | 10/1976 | Tucker | F42B 12/50 102/513 |
| 4,128,059 | A | 12/1978 | Black | |
| 4,281,599 | A | 8/1981 | Weber et al. | |
| 4,446,794 | A * | 5/1984 | Simmons | F42B 12/70 102/334 |
| 4,716,835 | A * | 1/1988 | Leemans | F42B 8/16 102/529 |
| 5,035,183 | A | 7/1991 | Luxton | |
| 5,388,524 | A | 2/1995 | Strandli et al. | |
| 5,565,649 | A | 10/1996 | Tougeron et al. | |
| 6,619,211 | B1 | 9/2003 | Haeselich | |
| 7,004,074 | B2 | 2/2006 | Van Stratum | |
| 7,475,638 | B2 | 1/2009 | Haeselich | |
| 7,819,065 | B2 | 10/2010 | Haeselich | |
| 8,056,481 | B2 * | 11/2011 | Dindl | F42B 12/36 102/502 |
| 8,065,962 | B2 | 11/2011 | Haeselich | |
| 8,424,456 | B2 * | 4/2013 | Broden | F42B 8/14 102/444 |
| 8,485,102 | B2 | 7/2013 | Carlson et al. | |
| 8,640,621 | B2 | 2/2014 | Broden et al. | |
| 8,783,186 | B2 * | 7/2014 | Scanlon | F42B 12/40 102/513 |
| 8,813,652 | B2 | 8/2014 | Shin et al. | |
| 9,157,715 | B1 | 10/2015 | Lafortune et al. | |
| 9,217,627 | B2 * | 12/2015 | Sullivan | F42B 8/12 |
| 9,635,426 | B2 | 12/2017 | Carlson et al. | |
| 9,958,242 | B2 | 5/2018 | Sullivan et al. | |
| 2003/0051626 | A1 * | 3/2003 | Koger | F42B 30/08 102/473 |
| 2007/0089629 | A1 | 4/2007 | Marx | |
| 2008/0178758 | A1 | 7/2008 | Kapeles et al. | |
| 2011/0252999 | A1 | 10/2011 | Carlson et al. | |
| 2012/0020050 | A1 | 1/2012 | Longo | |
| 2012/0067242 | A1 * | 3/2012 | Shin | F42B 12/40 102/364 |
| 2013/0199396 | A1 * | 8/2013 | Broden | F42B 8/14 102/513 |
| 2014/0026778 | A1 | 1/2014 | Saxby | |
| 2014/0318402 | A1 | 10/2014 | Carlson et al. | |
| 2015/0083012 | A1 | 3/2015 | Matascio | |

FOREIGN PATENT DOCUMENTS

| | | | |
|---|---|---|---|
| WO | 2003048675 | A2 | 6/2003 |
| WO | 2007054077 | A1 | 5/2007 |

OTHER PUBLICATIONS

International Search Report of Corresponding International Application No. PCT/US2018/047960, dated October 18, 2018.

* cited by examiner

56

| Range [m] | Impact Angle [°] |
|---|---|
| 500 | -22.2 |
| 1000 | -12.6 |
| 1500 | -11.0 |
| 2000 | -12.1 |
| 2500 | -15.4 |

56

| Range [m] | Impact Angle [°] |
|---|---|
| 500 | -3.4 |
| 750 | -4.0 |
| 100 | -9.9 |
| 1250 | -15.0 |
| 1500 | -21.7 |

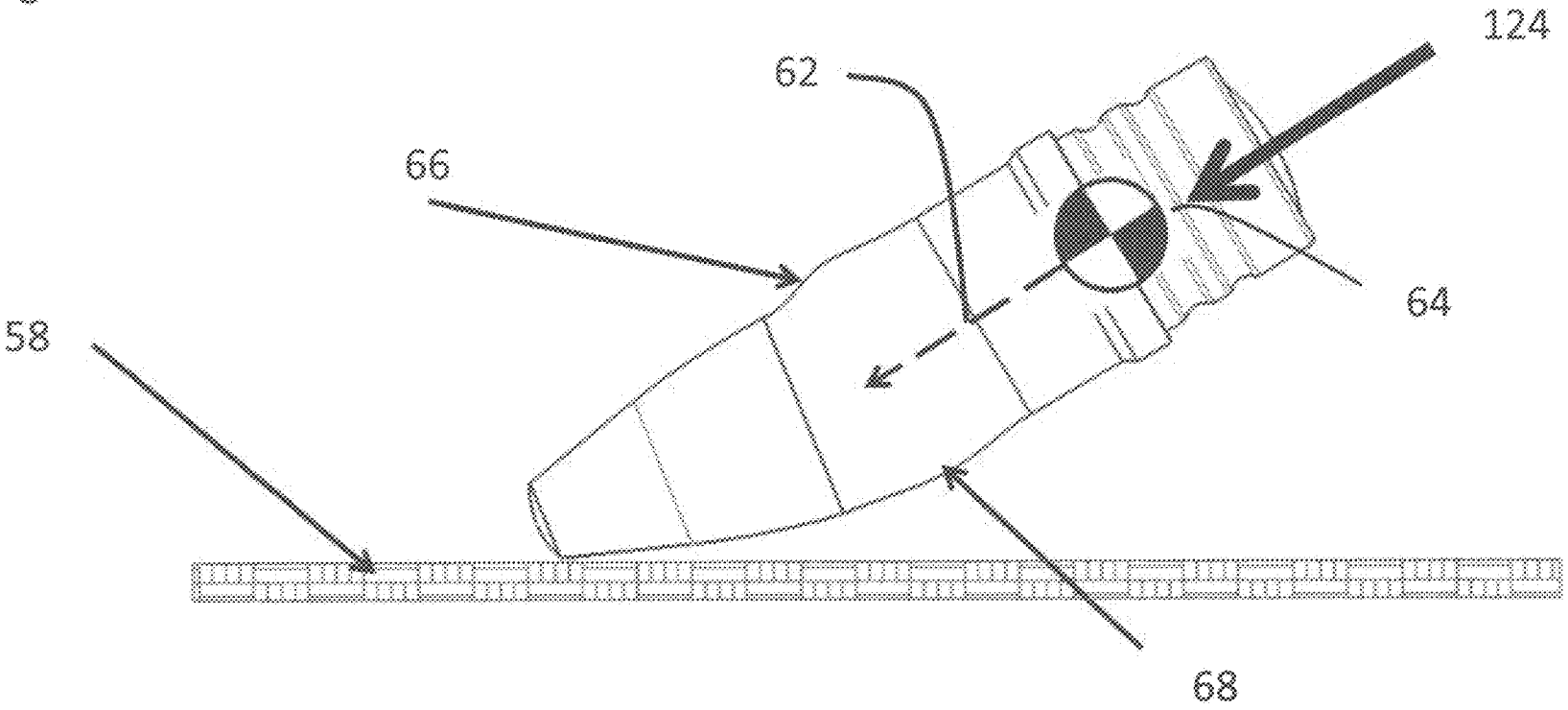
Figure 10B1

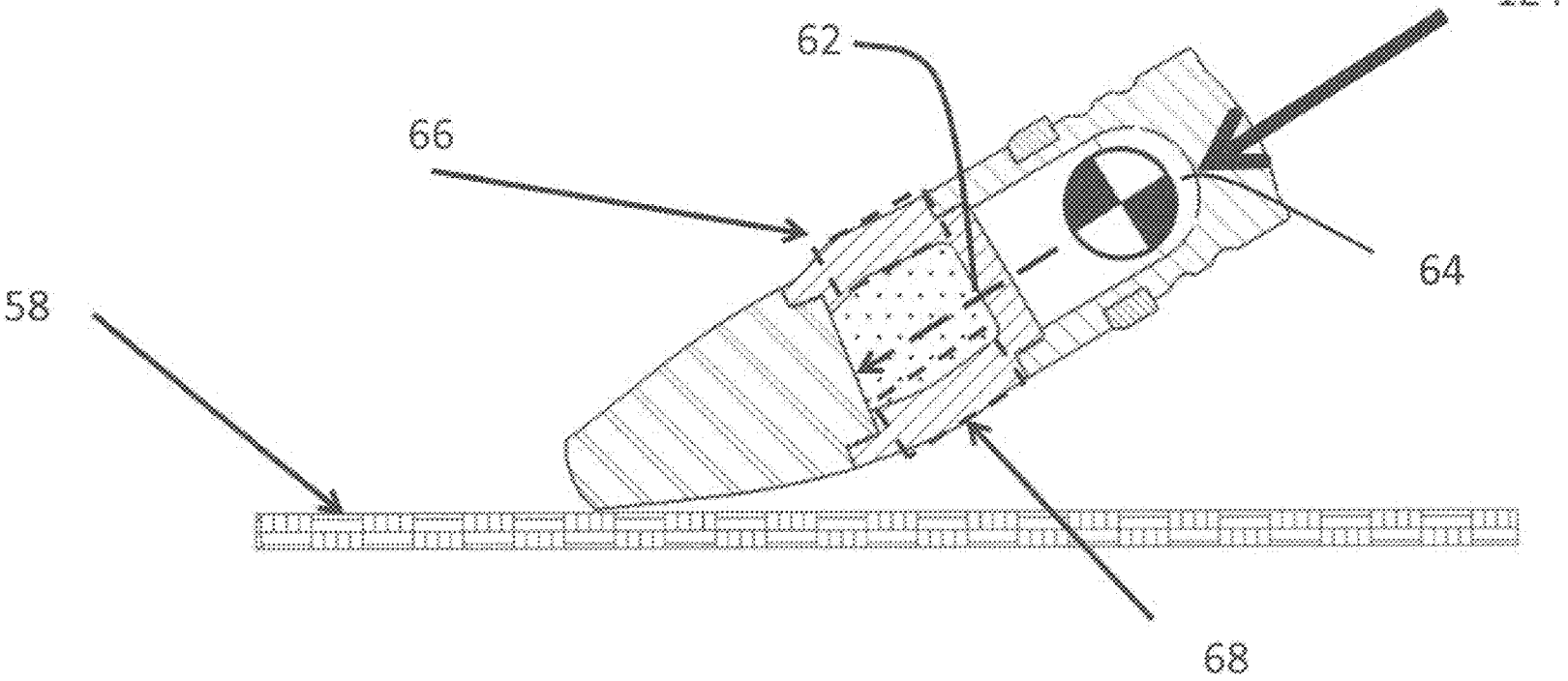
Figure 10B2

MID-BODY MARKING PROJECTILE

CROSS REFERENCE TO RELATED APPLICATION

This present application claims benefit of priority from U.S. Provisional Application Ser. No. 62/549,596 filed 24 Aug. 2017, entitled "Mid-Body Marking Projectile."

BACKGROUND OF THE INVENTION

Many militaries around the world typically become increasingly sensitive to the environmental impact of military training. Unexploded ordnance and associated clean up liabilities, are a significant consideration for procurement officials purchasing ammunition. In the field of spin stabilized, gun fired ordnance the US Army Research Development and Engineering Center (ARDEC) located at Picatinny Arsenal, developed the inexpensive M781 "chalk" round, that provided a visual signature for draft era conscripted soldiers. The frangible ogive of the M781 projectile was fabricated from plastic material, the plastic ogive further containing a marking powder. Normally, a training cartridge would have to survive a standard five-foot drop test; however, in the interest of reducing costs the Army waived the drop requirement supporting fielding of the M781, as the M781 dropped on a hard surface had a propensity to break open and spill the marking chalk from the ogive. Appearing in the early 1990s, 40 mm AGL's like the MK19, MK47, Santa Barbara 40 mm, H&K 40 mm provided users with exceptional firepower, firing a 40 mm projectile to a distance of two kilometers. The initial training cartridges offered with the US M918 cartridge which included fuzed pyrotechnics that were inherently expensive to produce and further produced a significant volume of problematic unexploded ordnance (UXO). Seeing a market opportunity, Nico Pyrotechnik GmbH & Co Kg developed a high velocity 40 mm cartridge with a nose mounted marker. This Nico design depicted in WO 2005/098345A8 was able to survive a typical rough handling test, as the cartridge included a useful internal container to insure marking powder did break and spill encapsulated marking powder into the weapon during feeding. This cartridge entered service with the US Marine Corps and USSOCOM with the nomenclature MK281 MOD 0. Nico, having been purchased by Rheinmetall, then incorporating useful chemiluminescent markers using technology taught in U.S. Pat. No. 6,619,211, RE40482 and U.S. Pat. No. 6,990,905 and WO 2007/0054077A1, the new technology providing a day and night signature, at impact. The updated US Marine Corp cartridge adopted these technologies and receiving the updated designation MK281 MOD 1.

We should also note that General Dynamics (Canada) has been awarded U.S. Pat. No. 9,157,715 B1 Polymer Marking Projectile with Integrated metallic Sealing Ring (GD Canada). This General Dynamics Canada design has a polymer ogive and body that, upon impact, compresses, to deform the polymer nose, the resulting deformation expelling a marking compound. We should note that the resulting deformation of the polymer body creates vents with an orientation parallel to the projectiles axis of rotation. In this impact configuration, the marking material is ejected from the vents, and the ejected marking powder attaches itself to the target.

SUMMARY OF THE INVENTION

The cartridge incorporating a marking projectile, that affords gunners with a visual impact cue to identify the location of a projectile's impact. The cartridge survives typical drop testing and can function in a machine gun or cannon. At impact in the vicinity of a target, impact forces act on the projectile body inducing a wall failure that expels marking powder into the atmosphere. The projectile's break up on impact, reduce the risk of ricochet.

Use and Function Fire: Advantageously, the new product provides for a marker that will function in most terminal conditions, without producing UXO. The design incorporates a base with a substantial mass that, at the moment of impact, harvests the forward inertia of the mass in the base, the mass compressing a mid-body component that encapsulates a marking powder. Also, the walls will normally have adequate strength allowing the cartridge to survive typical drop tests. These drop tests reflect user requirements that a cartridge remain intact when being transported and handled in a military environment. The design includes a robust metal nose, providing a feature that allows for a projectile to pass a typical 5 foot drop test. As training cartridges generally have a ballistic match requirement to operational projectiles, the design must establish a center of gravity in the projectile affording a good match to operational cartridges. Where a designer desires to move the center of gravity forward, the preferred design may include a steel nose. Where the designer needs to move the center of gravity to the rear of the projectile, the designer can utilize an aluminum nose. In addition to surviving drop tests, a cartridge may have to function in sever compression. By way of example, a MK19 MOD 3 40 mm AGL will induce significant tension and compression on the cartridge when the weapon delinks the projectile from the ammunition belt and the cartridge undergoes compression when the bolt and extractors force the cartridge forward in the MK19s base feeder. Thus, a 40 mm AGL projectile utilizing a mid-body marker design must insure the mid-body wall provides requisite strength for feeding, and break on impact.

Impact Marking Function. At impact, the combination of forces act to induce failure in the projectile's mid body wall, releasing and then expelling the encapsulated powder from the disintegrating body. While the mid-body wall fails in impact conditions, the walls have adequate strength to undergo compression, as many cartridges undergo considerable compression in weapon feeding. The wall failure, at impact, depends on material selection. Generally, a designer can use a typically polymer that will shatter and separate from the projectile at impact, where the nose undergoes an abrupt de-acceleration, and the inertia in the base squeezes the mid-body marker wall, causing failure and allowing forces to eject the marking powder, and allowing the heavier metal base to continue forward movement after wall failure, compressing and causing ejection of the powder, post wall failure. Marker and Marker Ejection: Advantageously at impact, shear forces, rotational forces and collapsing mid boy walls, all act on the powder to eject the marker into the atmosphere. Typically, the marking powder is a low density material that includes pigmentation or dyes that provide a strong contrast with the colors in the ambient environment. Typically, the marking powder is ejected in a pattern from the mid-body, such that the ejected material is buoyed in the atmosphere proximate to the impact and and perpendicular to the projectiles axis of rotation.

Reduced Ricochet: At impact the body, disintegrates producing aero-ballistically inefficient fragments, with reduced mass, the terminal impact in combination reduce the risk of fragment ricochet. Ranges with exposed rocky outcrops frequently produce ricochets. Ricochet fragments frequently require militaries to set aside significant amounts of land as surface danger zones.

DESCRIPTION OF PREFERRED EMBODIMENTS

The preferred embodiments of the present invention will now be described with reference to FIGS. 1A to 11F of the reference drawings. Identical elements of the various figures are designated with the same reference numbers, incorporated into three different types of gun fired cartridges depicted herein in three configurations—30 mm×113 cartridge, 40 mm×53 cartridge and a 105 mm Tank cartridge.

FIGS. 1A-8C depicts embodiments of the cartridge configuration in 30 mm, 40 mm and 105 mm projectiles.

FIG. 1A depicts 30 mm gun fired cartridges (2) with driving bands (42). A cartridge case (4) encloses propellant powder (8).

Figure 3A:
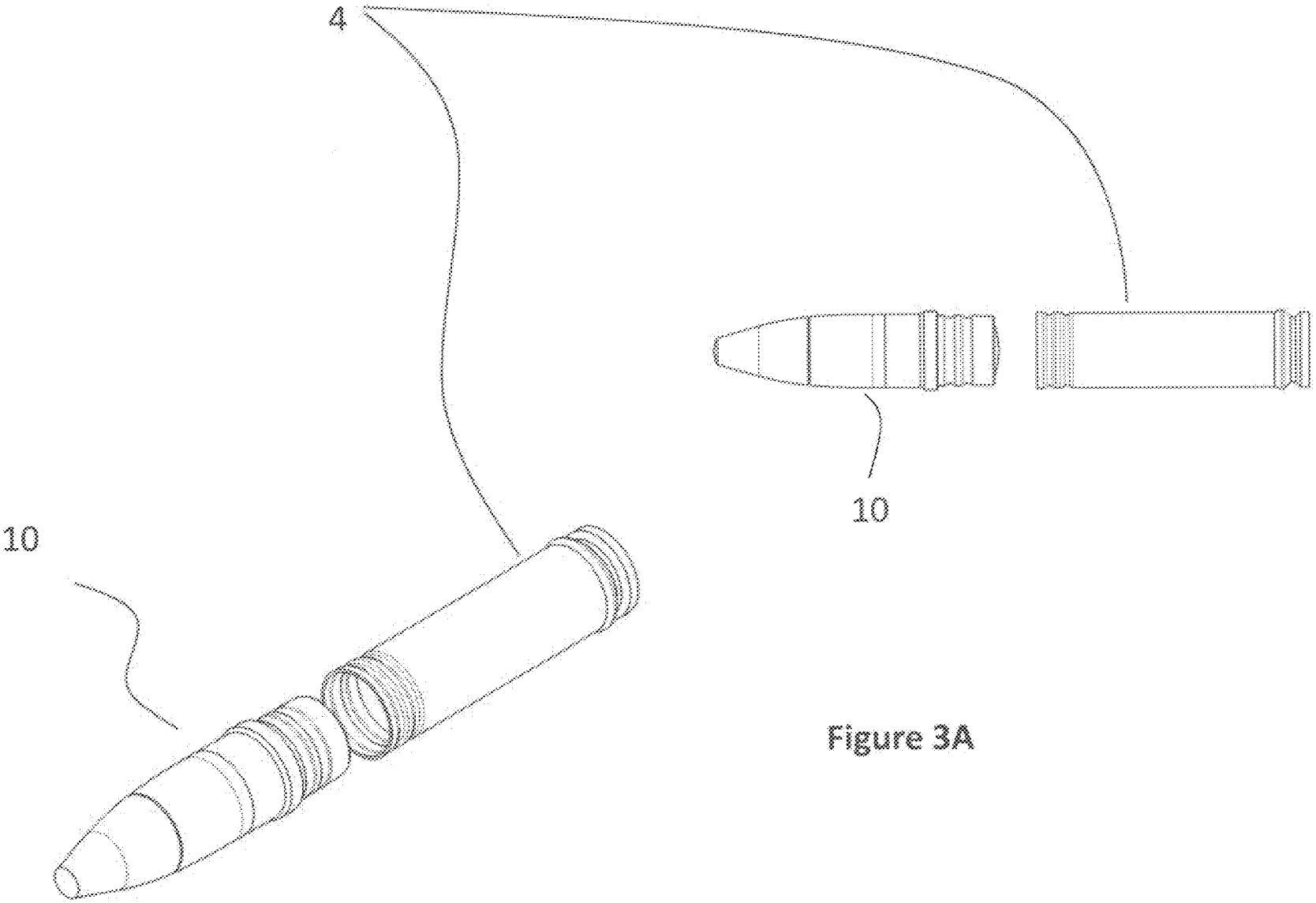
Figure 3B:
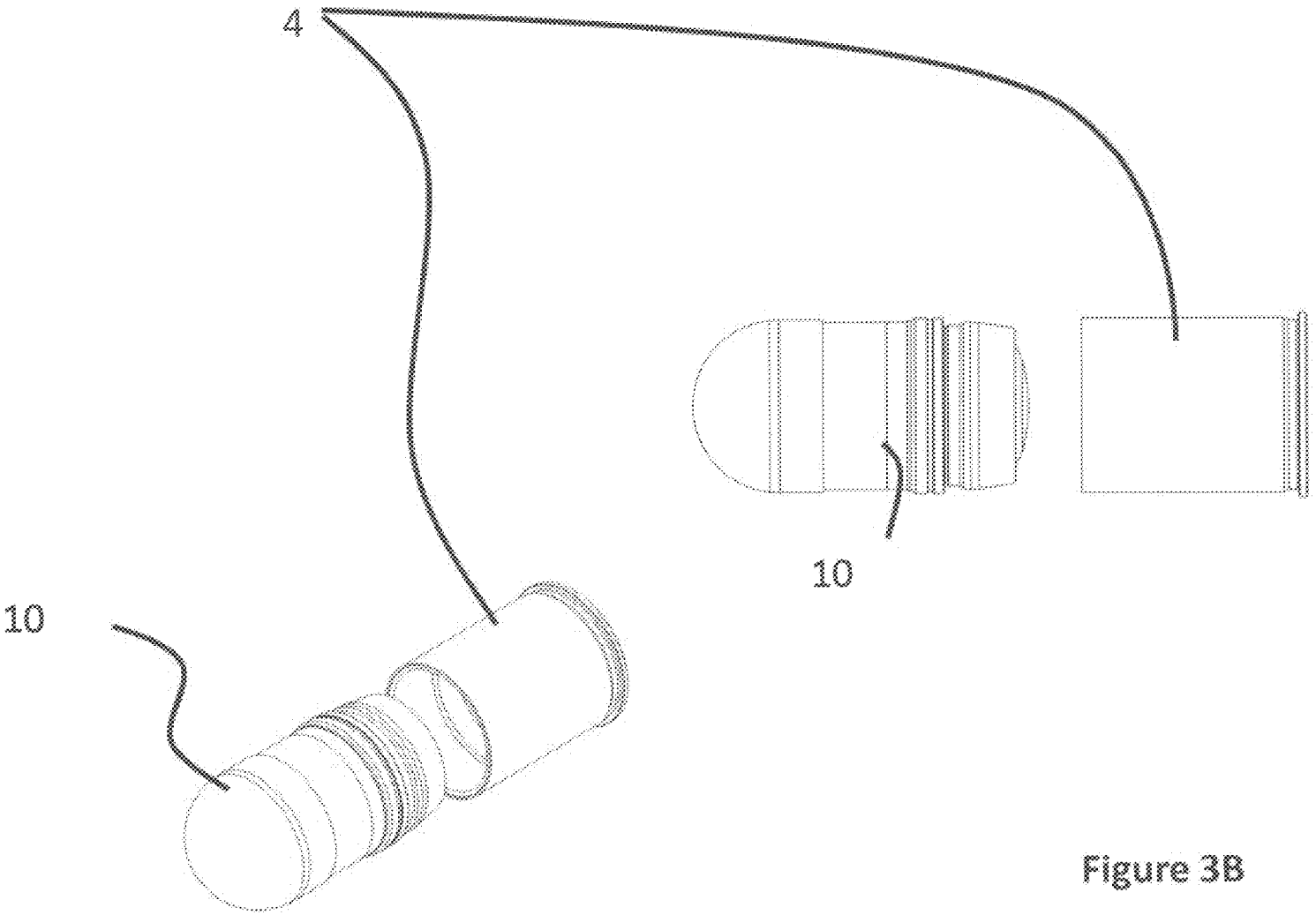
Figure 3C:
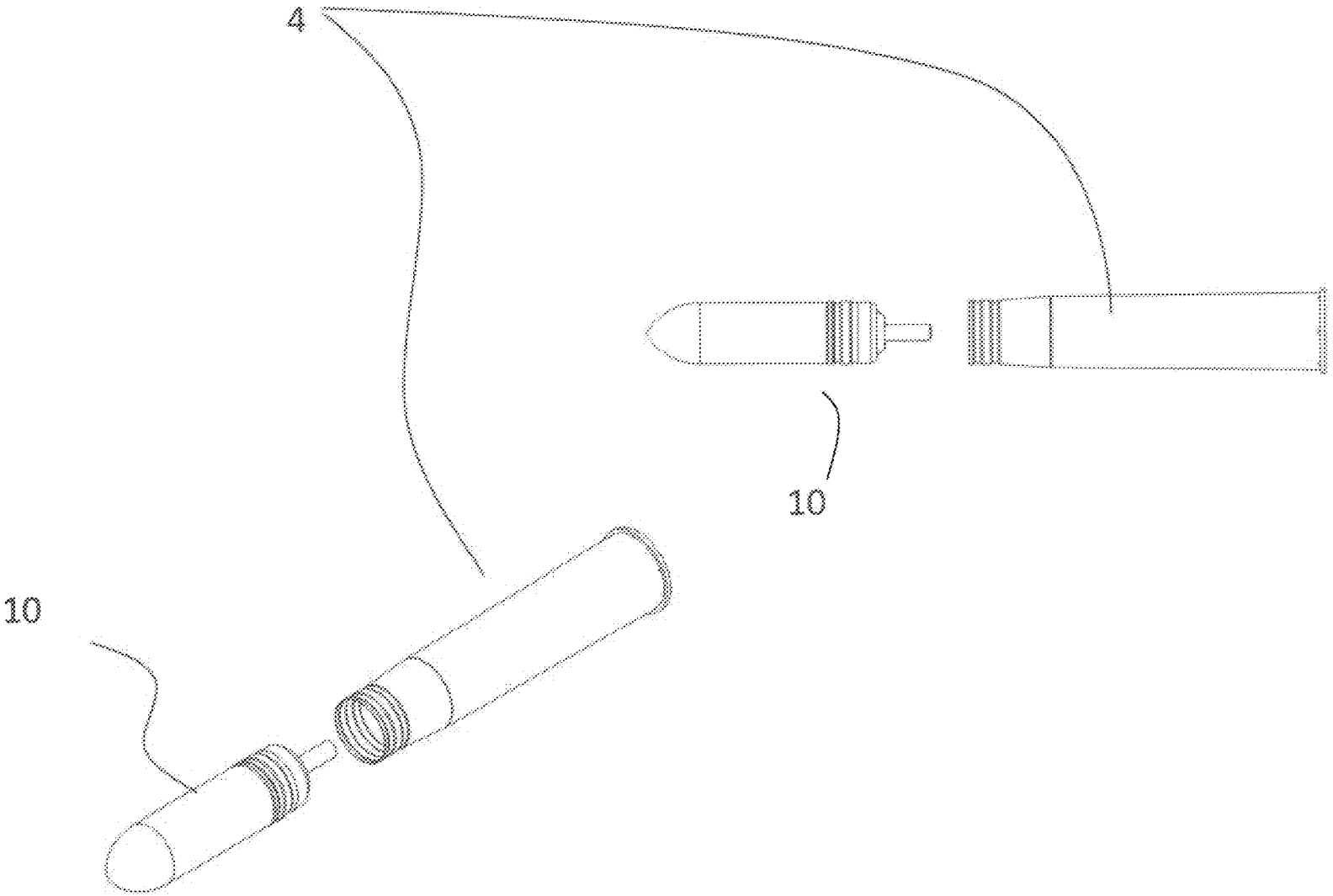

FIG. 3A depicts a 30 mm projectile (10) incorporated into a cartridge case (4). FIG. 3B depicts a 40 mm projectile (10) and cartridge case (4). FIG. 3C depicts a 105 mm tank projectile (10) and a cartridge case (4).

Figure 4A:
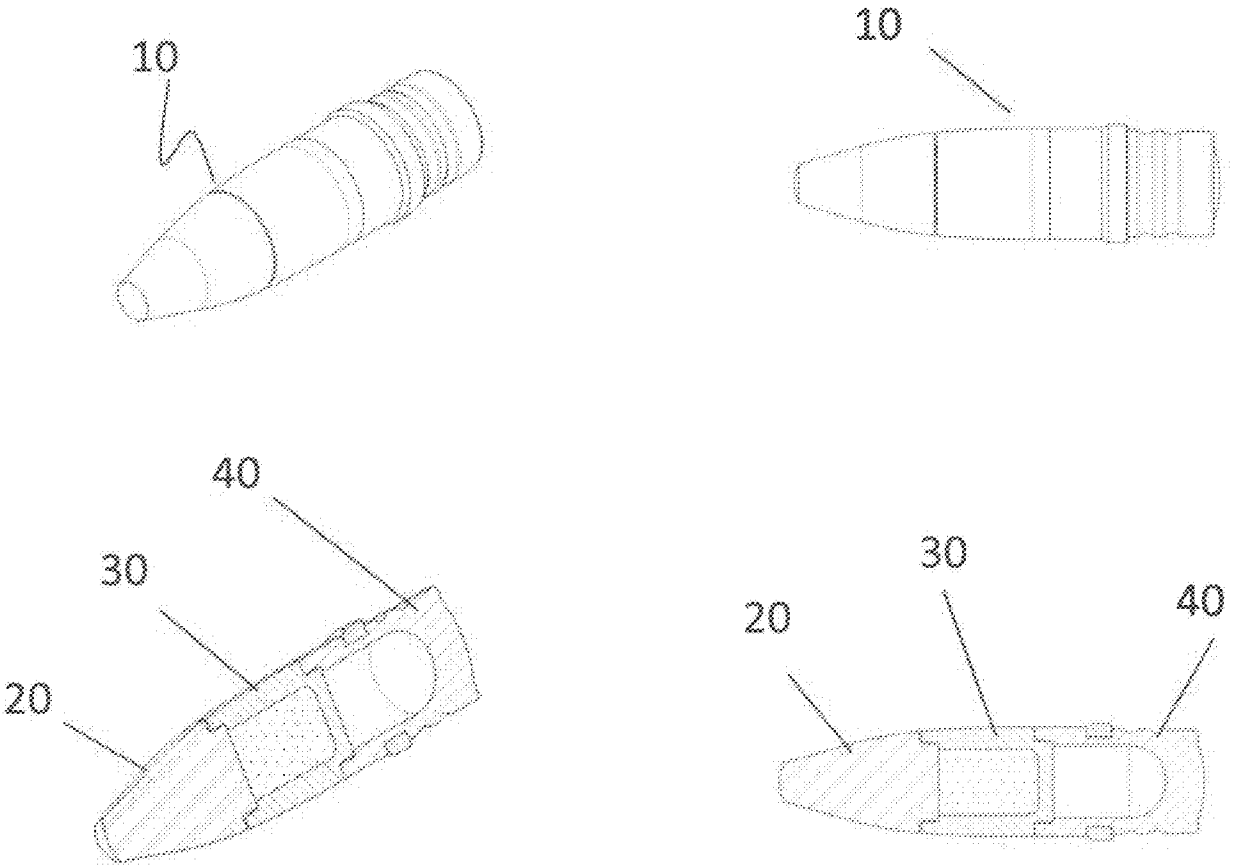

FIG. 4A depicts external and section views of a 30 mm marking projectile (10) composed of three principle components—a nose cap (20), marking body (30) and a metallic, non-frangible projectile base (40).

Figure 4B:
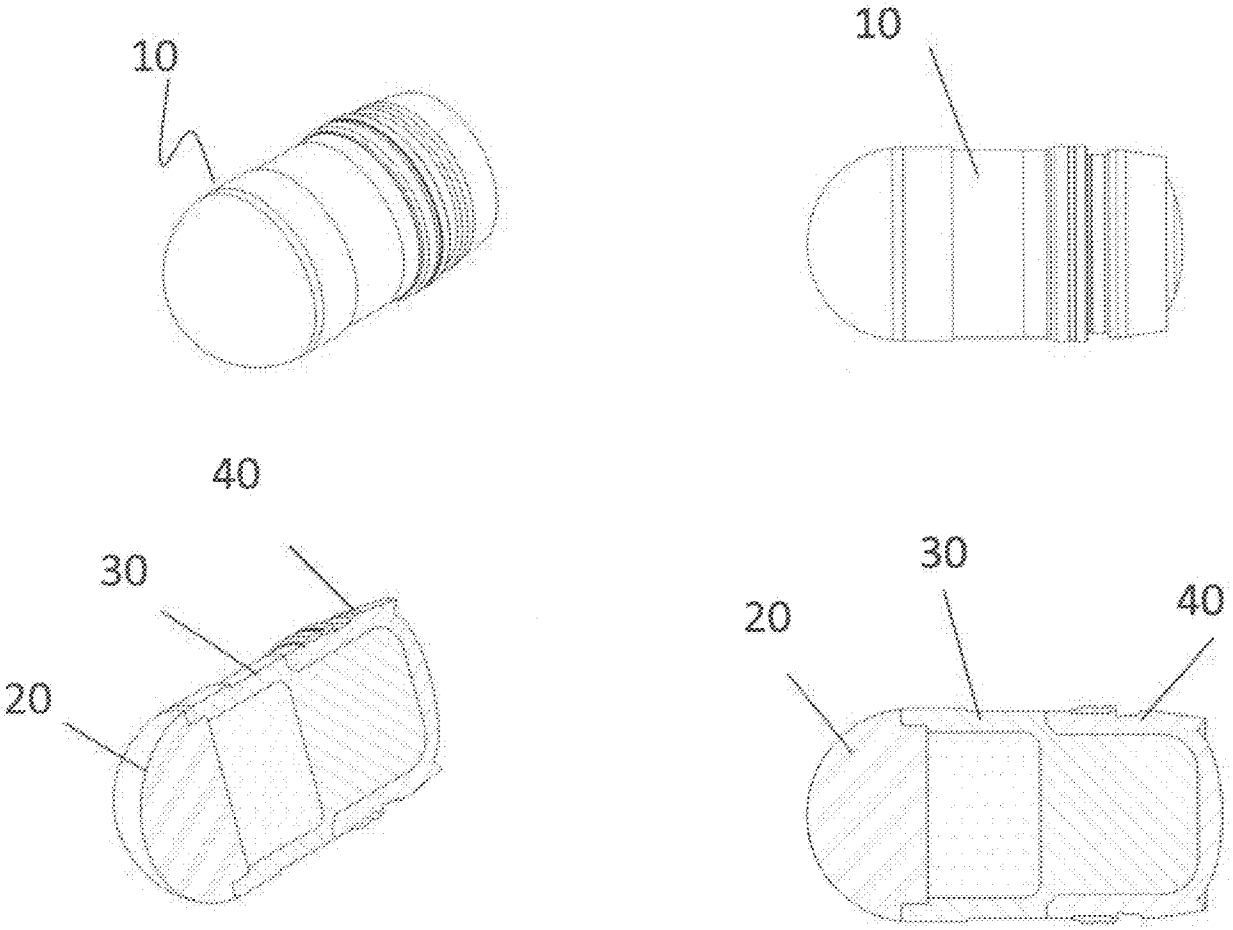

FIG. 4B depicts external and section views of a 40 mm marking projectile (10) composed of three principle components—a nose cap (20), marking body (30) and a metallic, non-frangible projectile base (40).

Figure 4C:
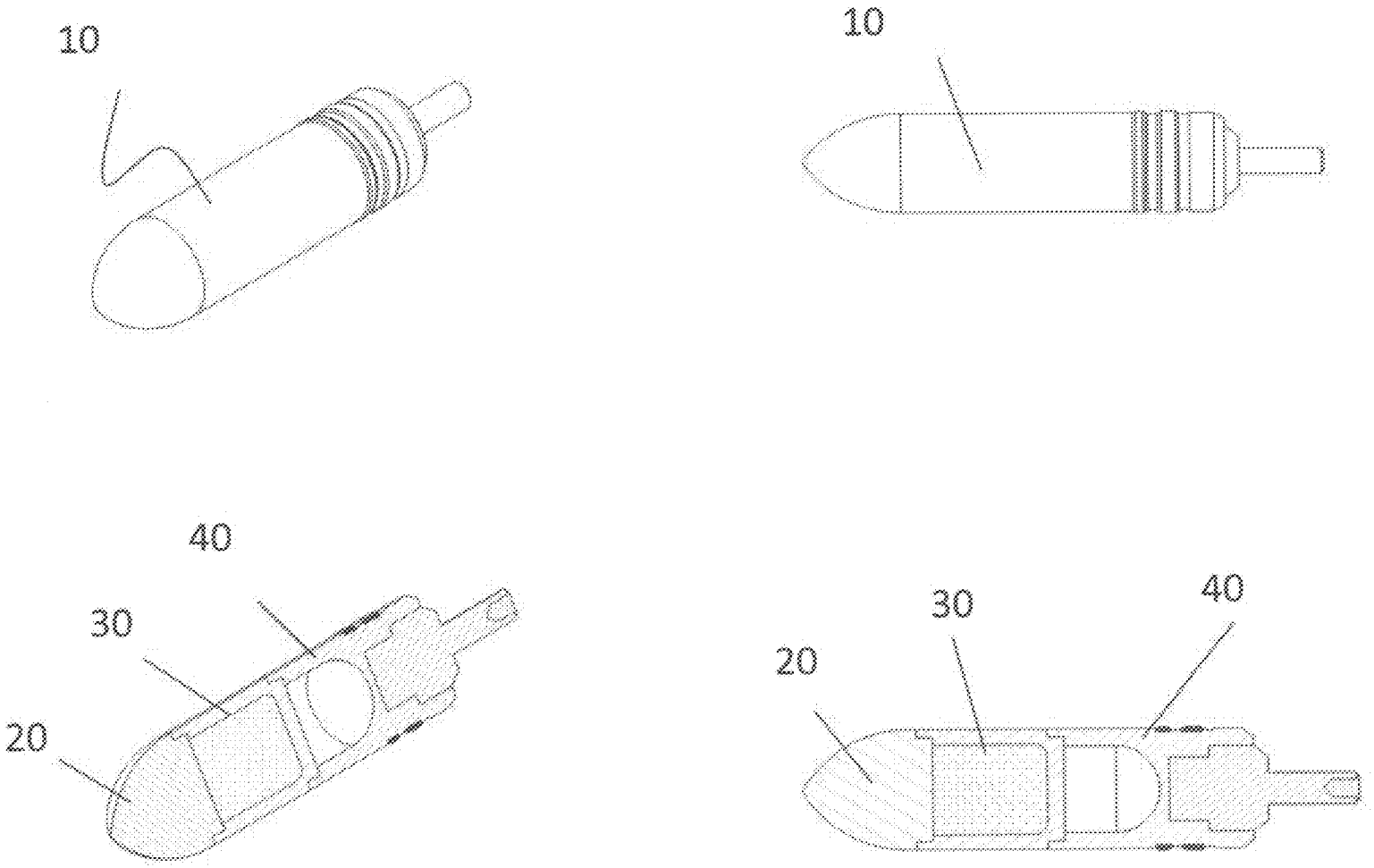

FIG. 4C depicts external and section views of a 105 mm marking projectile (10) composed of three principle components—a nose cap (20), marking body (30) and a metallic, non-frangible projectile base (40).

Figure 5A:
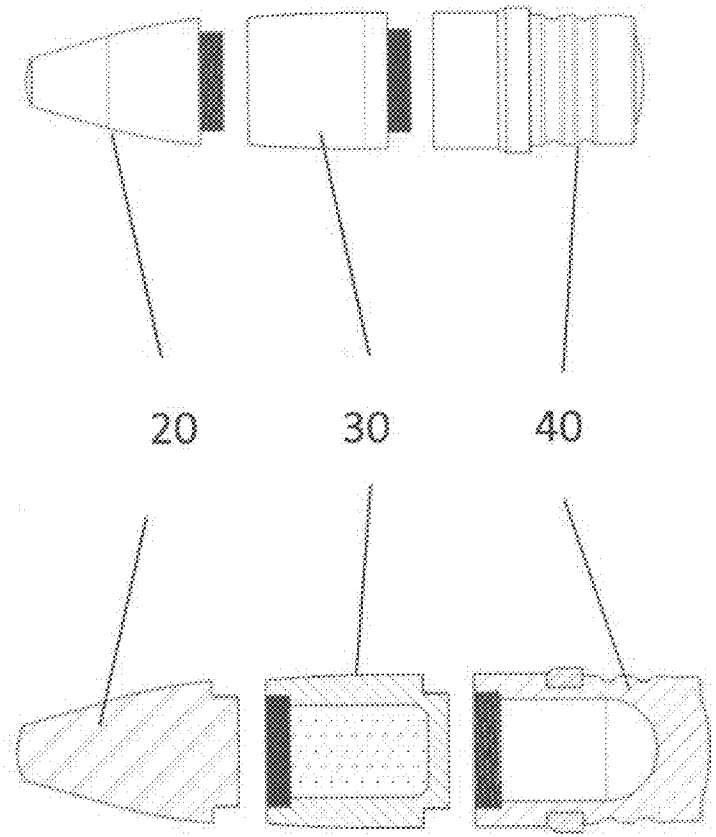
Figure 5A:
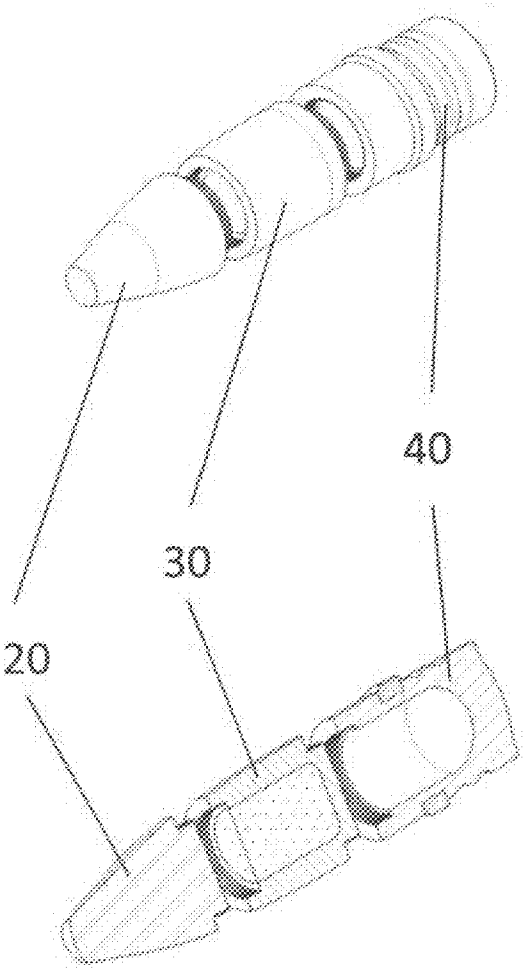

FIG. 5A depict an exploded view of a 30 mm marking projectile (10) and the principle elements—a nose cap (20), marking body (30) and a metallic, non-frangible projectile base (40).

Figure 5B:
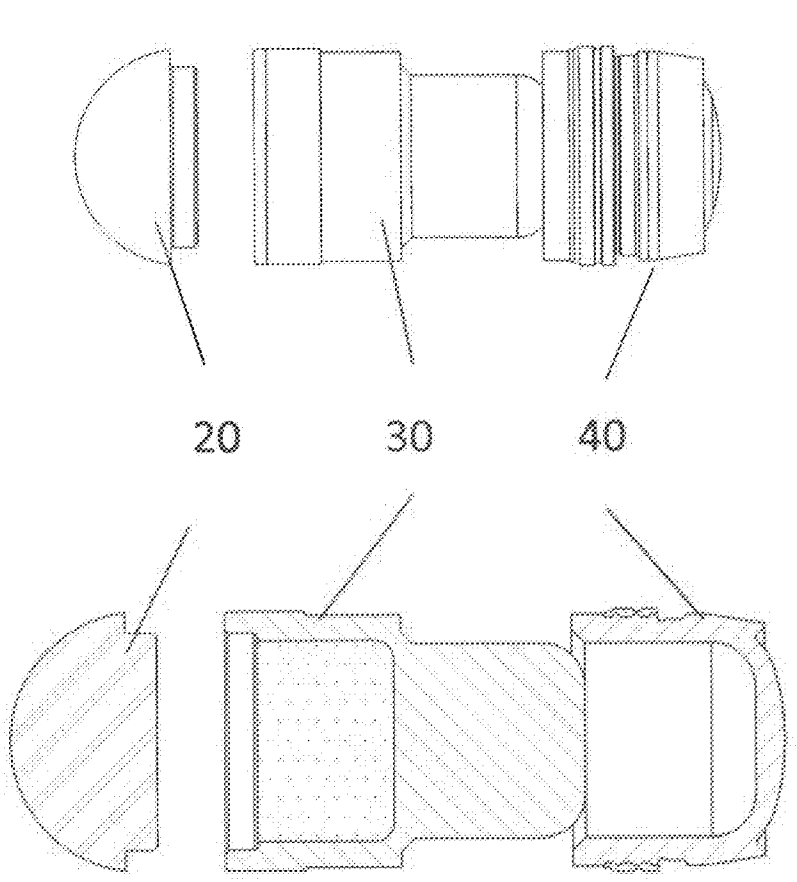
Figure 5B:
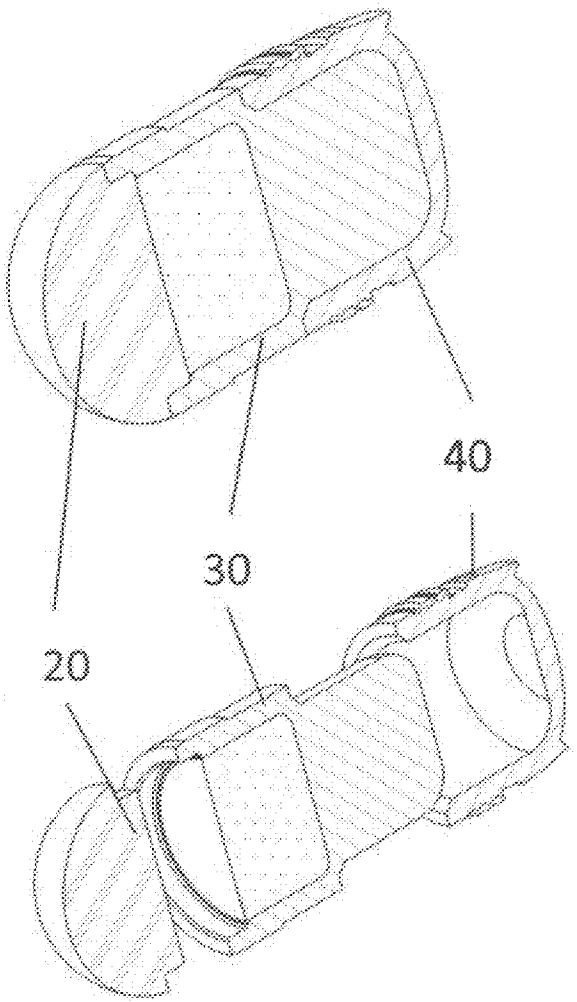

FIG. 5B depict an exploded view of a 40 mm marking projectile (10) and the principle elements—a nose cap (20), marking body (30) and a metallic, non-frangible projectile base (40).

Figure 5C:
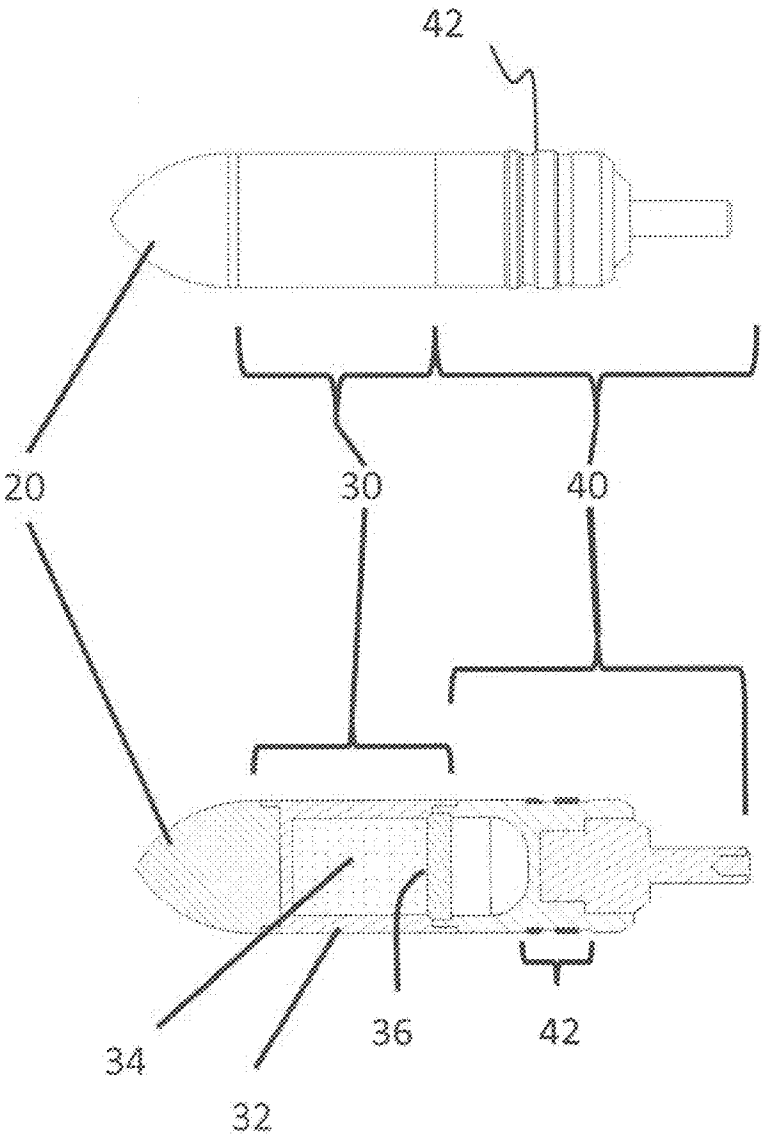
Figure 5C:
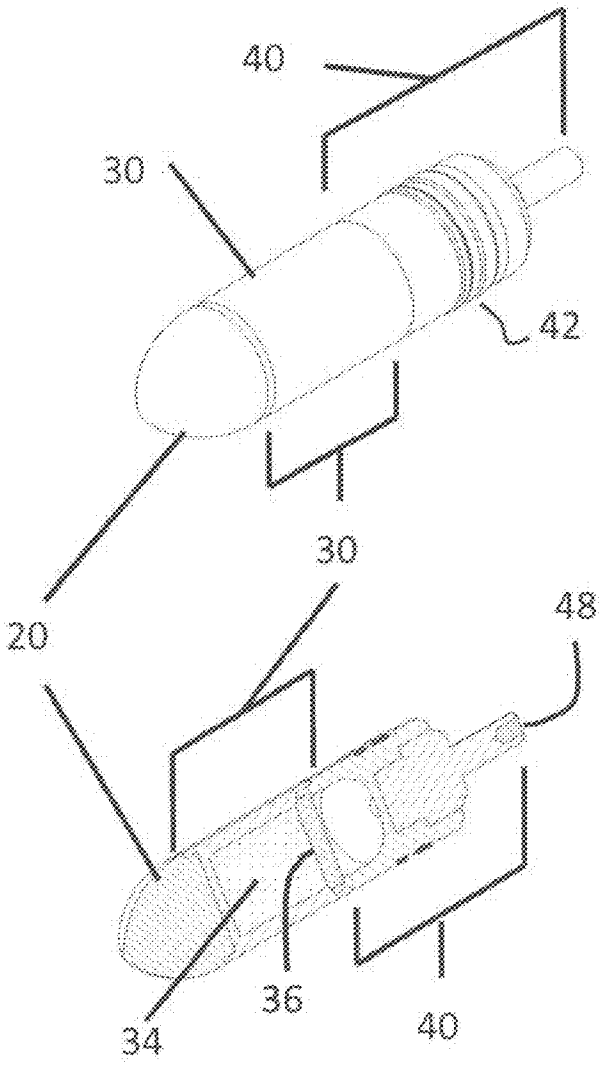

FIG. 5C depict an exploded view of a 105 mm marking projectile (10) and the principle elements—a nose cap (20), marking body (30) and a metallic, non-frangible projectile base. The base may also include a tracer assembly (46) or tracer element (48), the tracer providing a visual cue of the projectile's flight path.

Figure 5D:
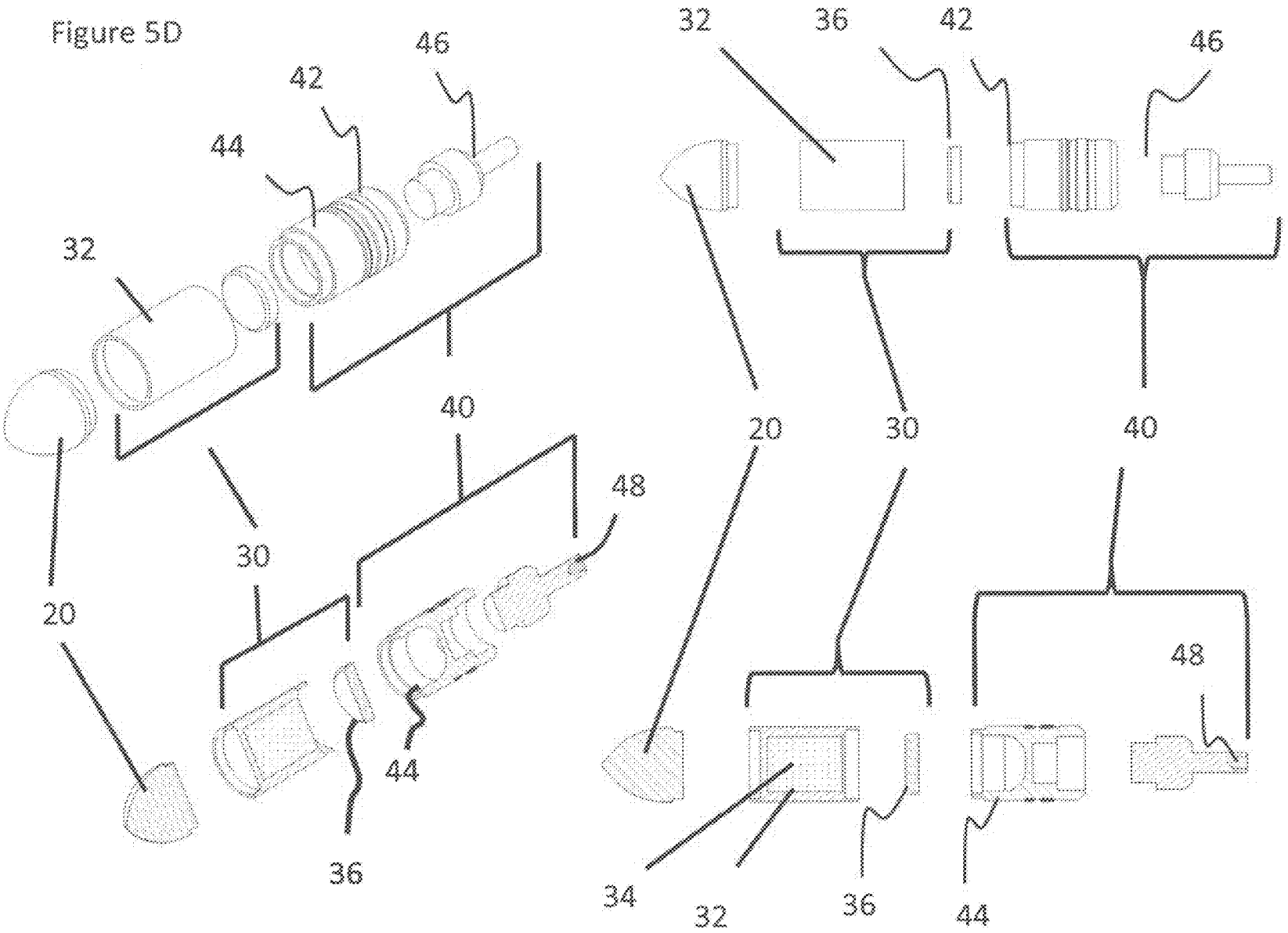

FIG. 5D depicts and exploded view of a 105 mm marking projectile (10), the principle elements (20,30 and 40) and an exploded view of the marking body (30) including a pusher plate (36), and a base including a driving band (42) affixed to a non-frangible body (44), tracer assembly (46) and tracer element (48).

Figure 6A:
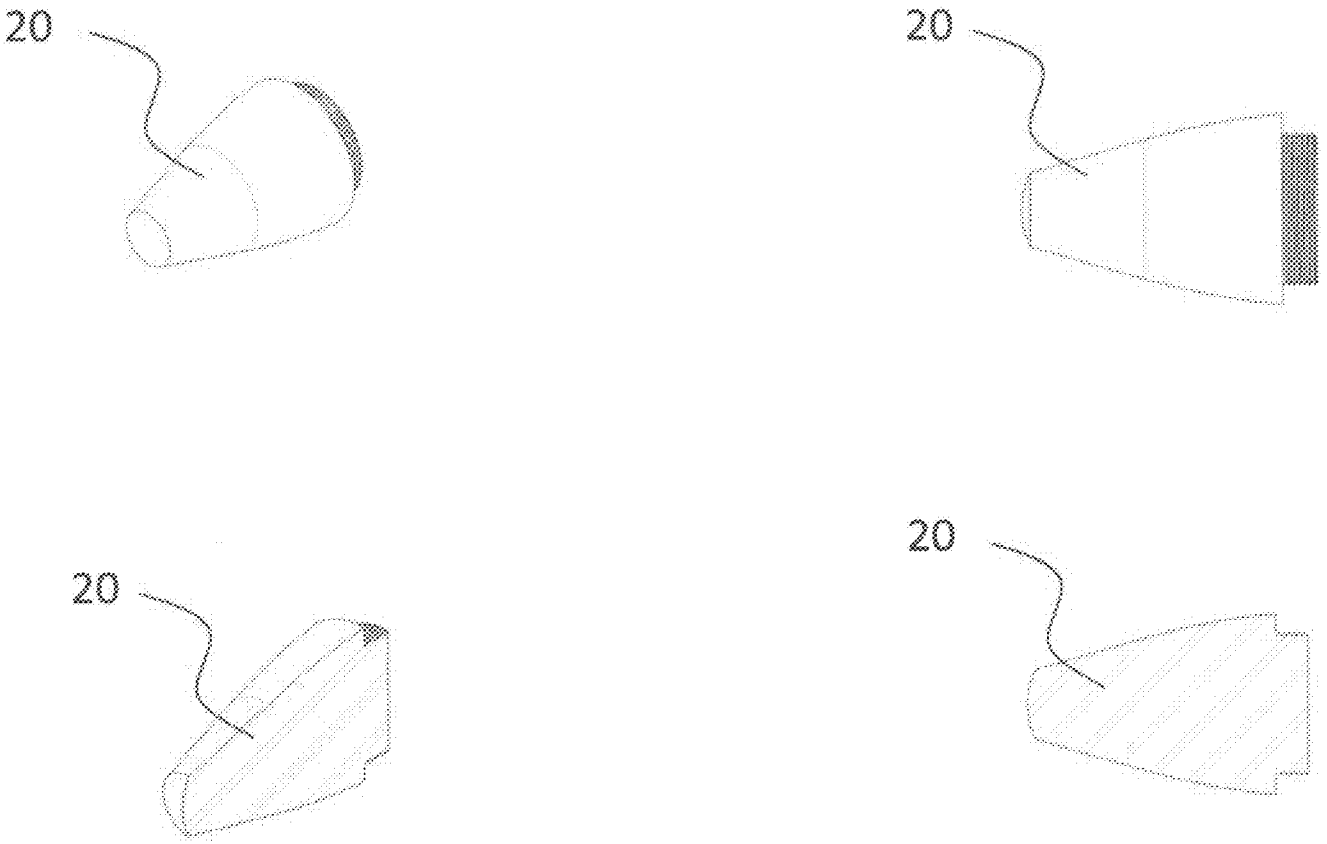
Figure 6B:
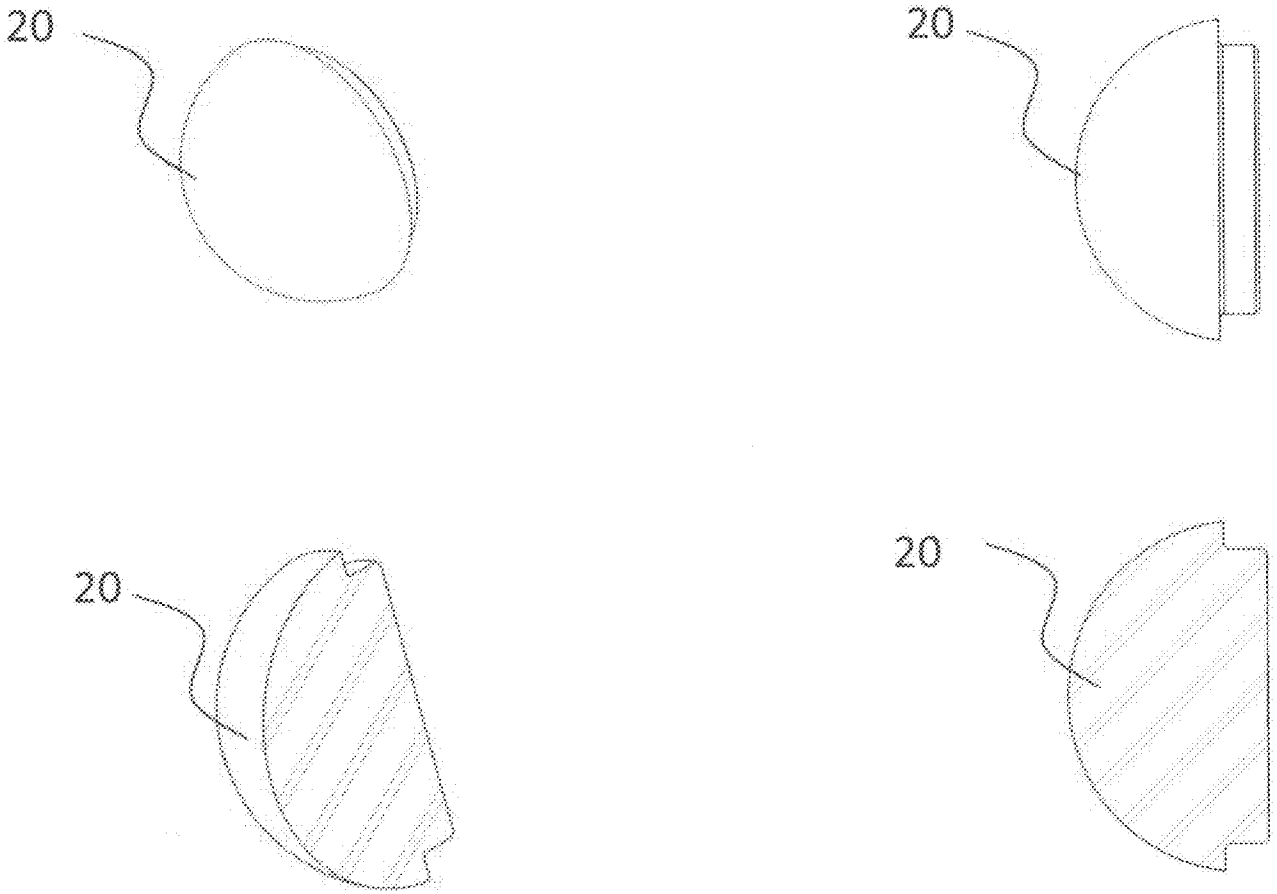
Figure 6C:
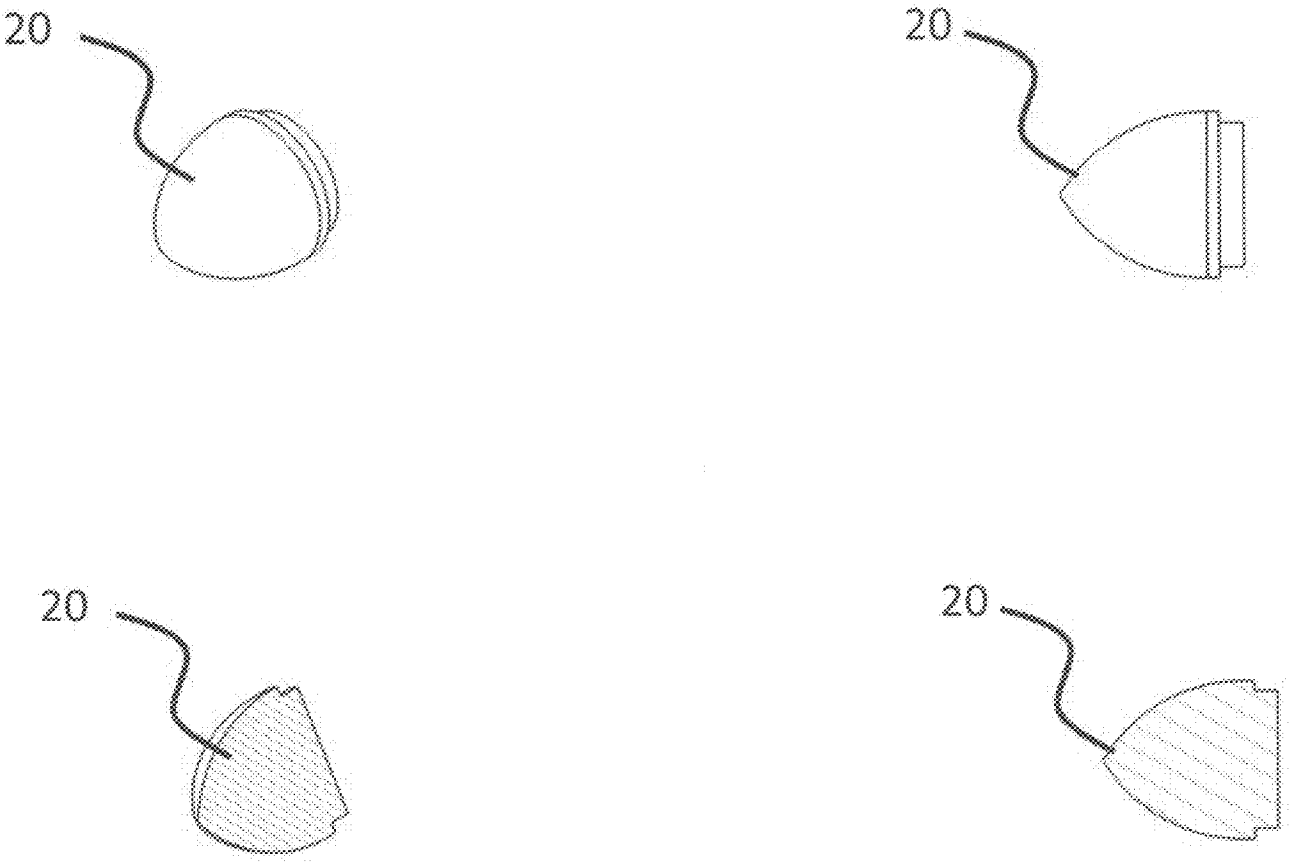

FIG. 6A-6C depict metallic nose caps (20) for 30 mm, 40 mm and 105 mm projectiles.

Figure 7A:
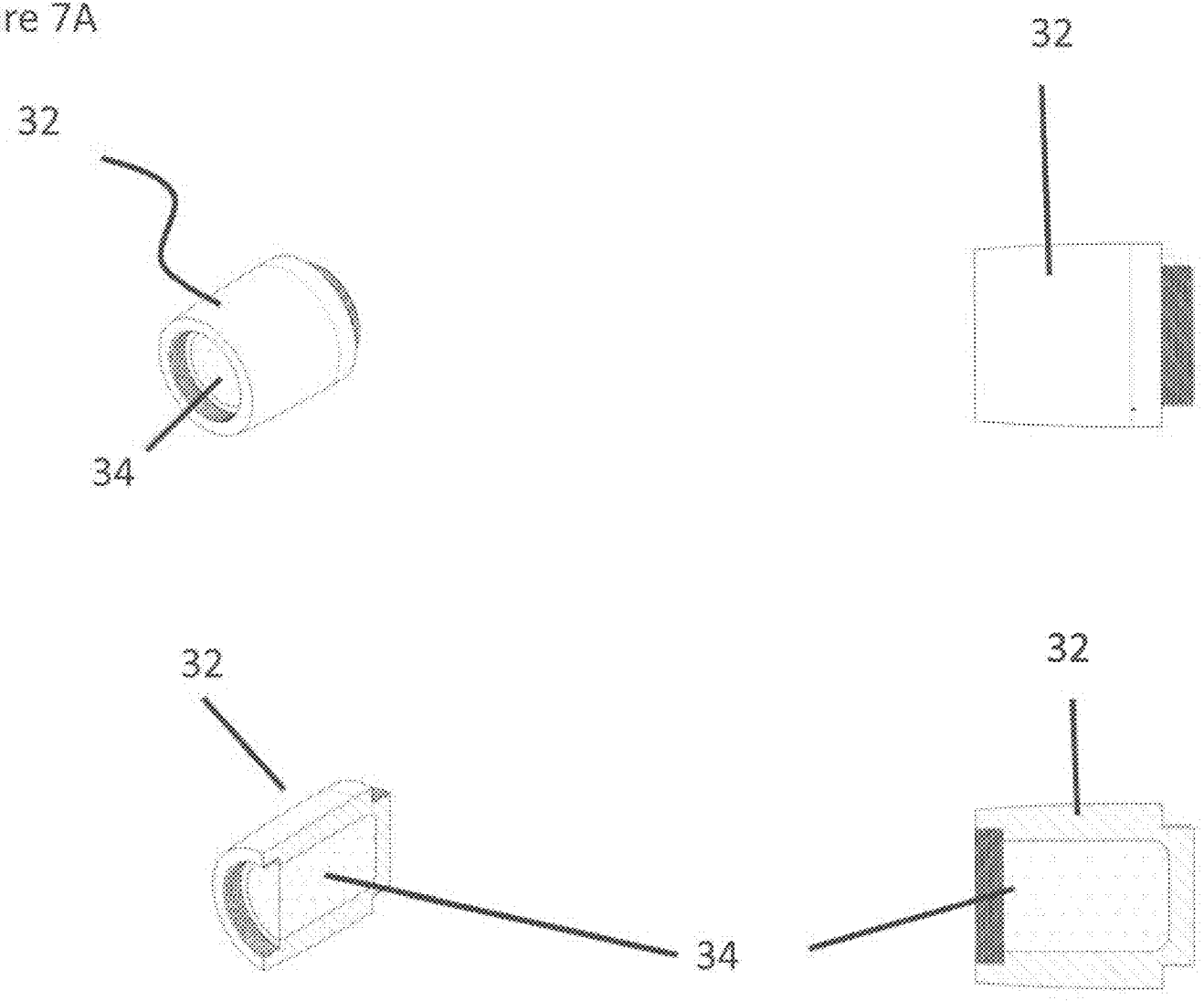
Figure 7B:
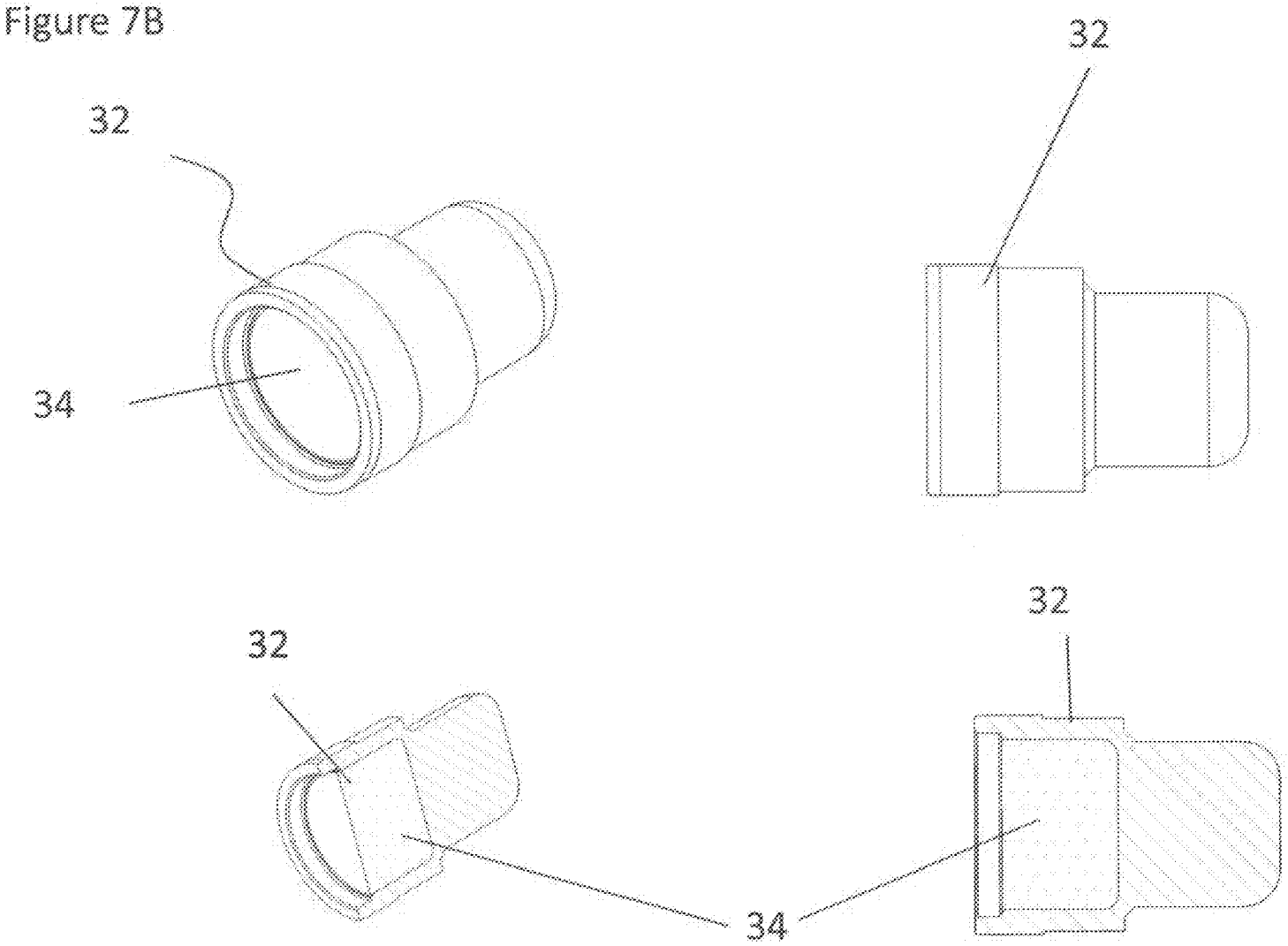
Figure 7C:
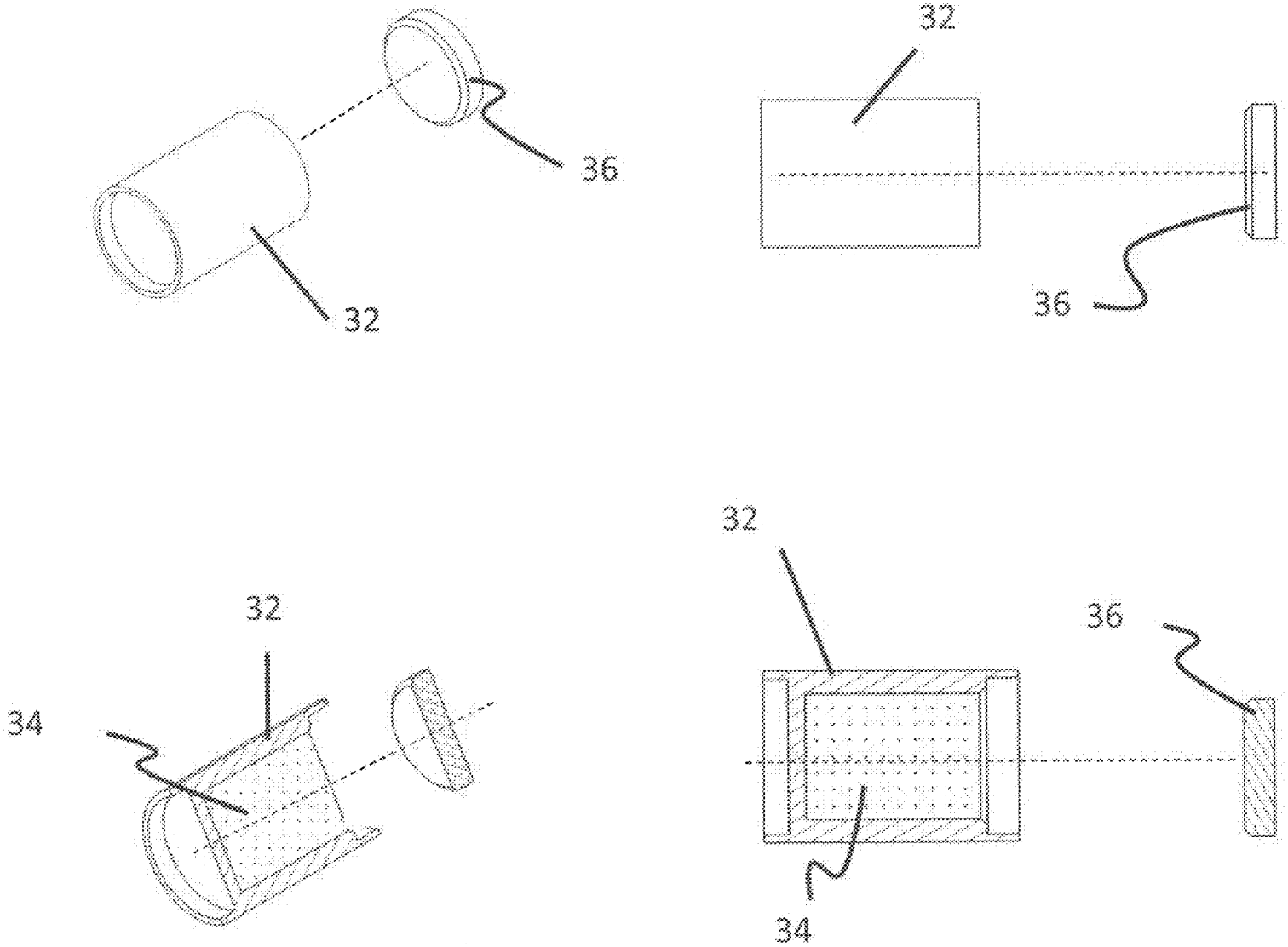

FIG. 7A-7B depict mid body marking bodies fabricated from a frangible body (32) and encapsulating a marking powder (34). FIG. 7C Depicts components in a 105 mm marking body including a frangible body (32), Contained marking powder (34) and a pusher plate (36).

Figure 8A:
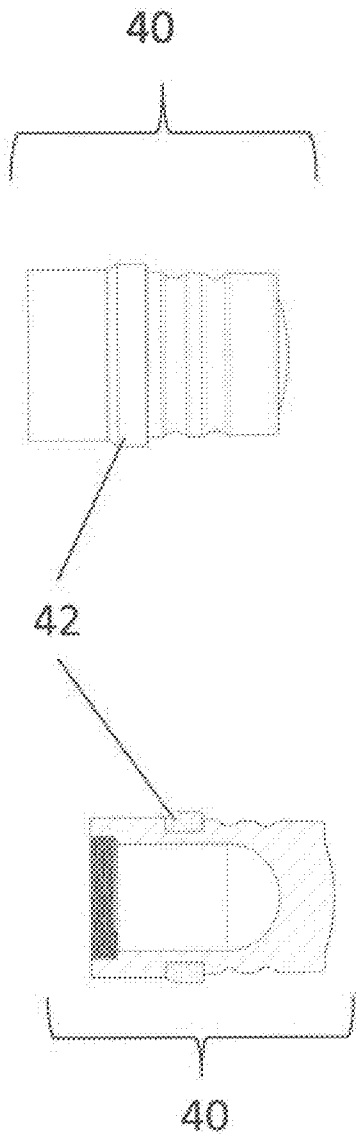
Figure 8A:
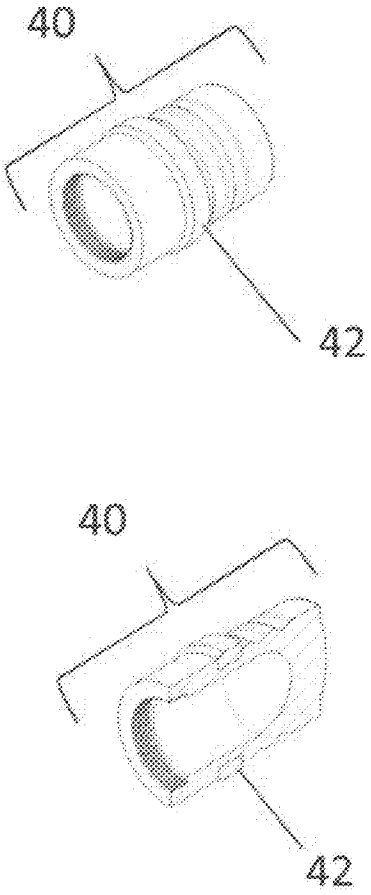
Figure 8B:
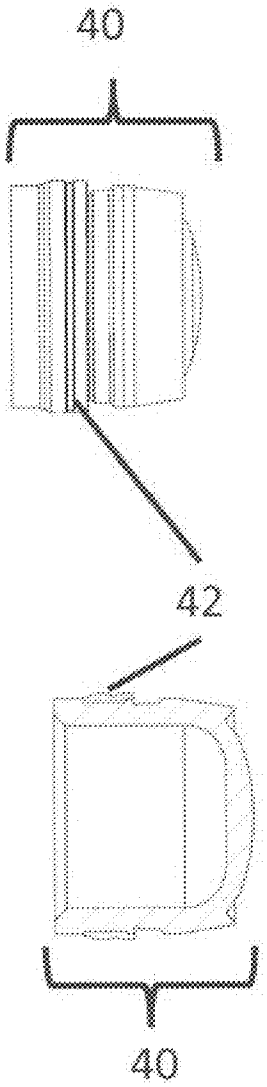
Figure 8B:
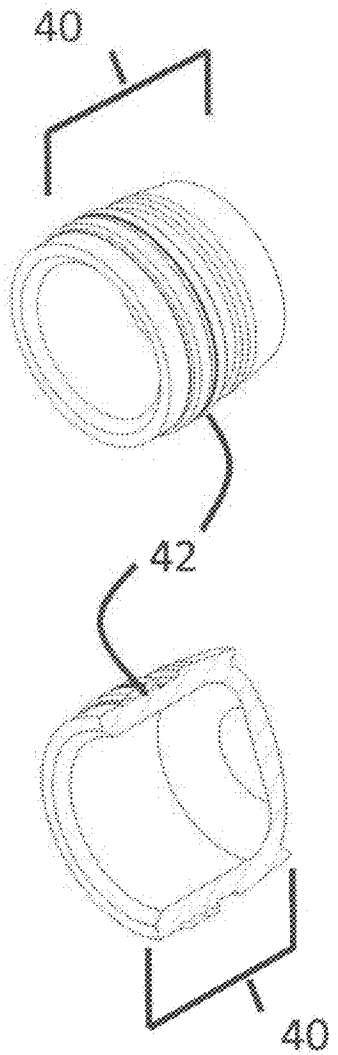
Figure 8C:
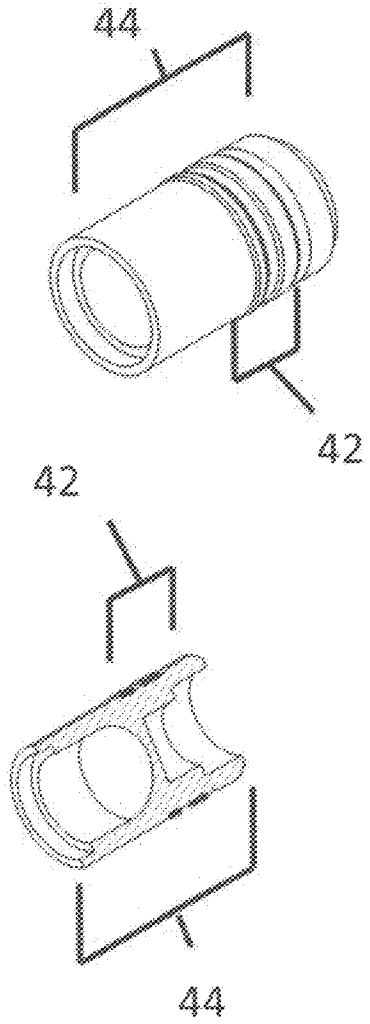
Figure 8C:
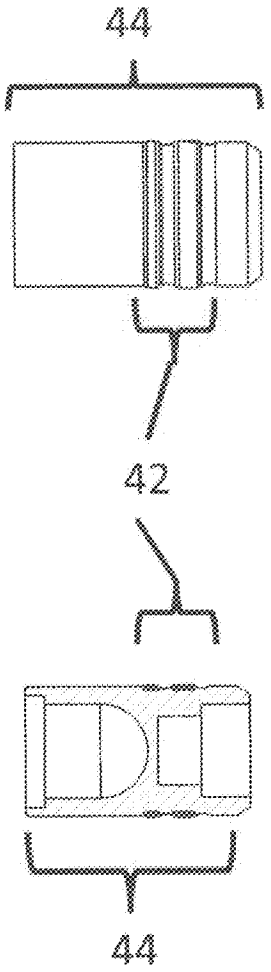

FIG. 8A-8B depict the non-frangible base preferably produced from a dense metal and incorporates a driving band (42). FIG. 8C depicts the non-frangible body (44) with driving band (42).

Figure 9A:
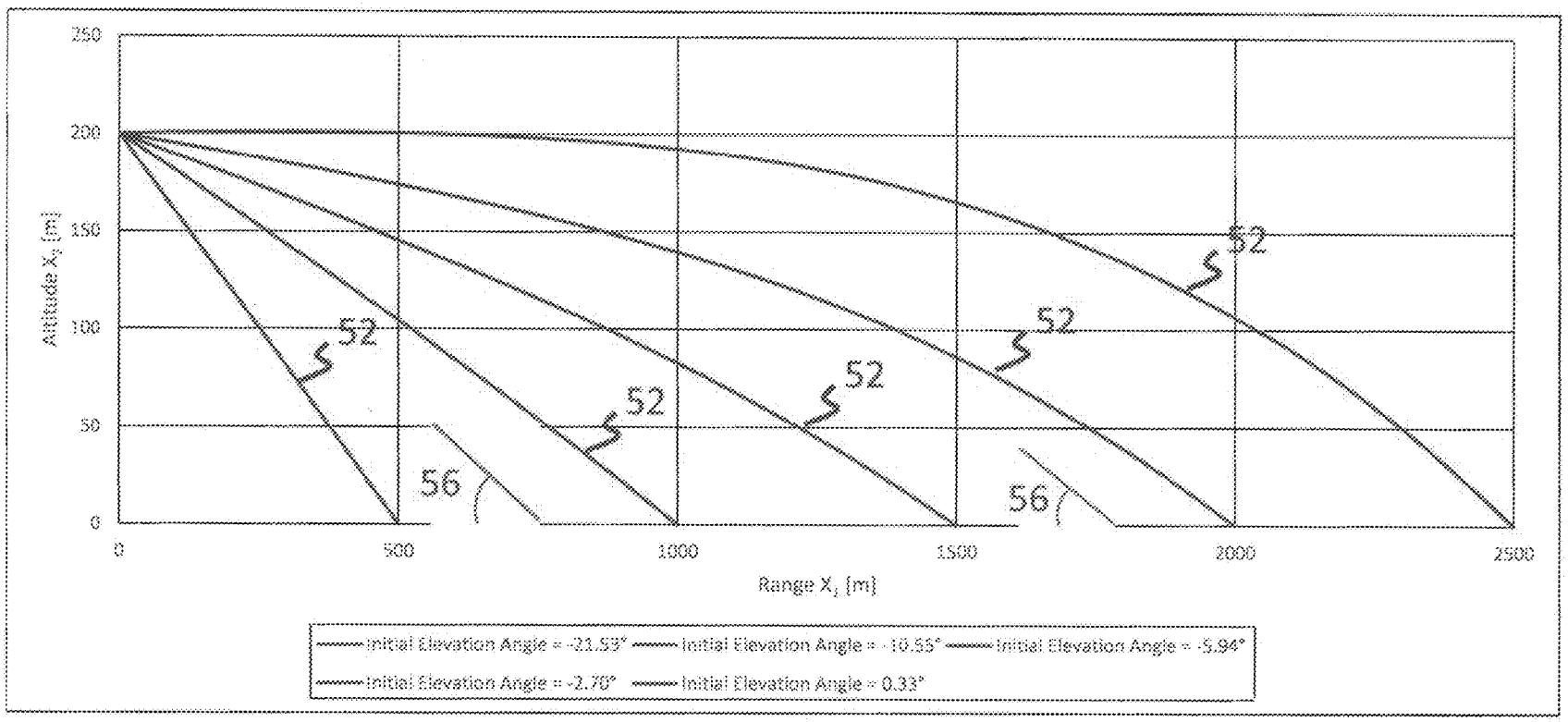

FIG. 9A depicts the trajectory and impact angle of 30 mm×113 projectiles fired from a helicopter firing at targets from 500-2500 meters. The table below the diagram (altitude versus range) identifies the impact angle of 30 mm projectiles at various ranges.

Figure 9B:
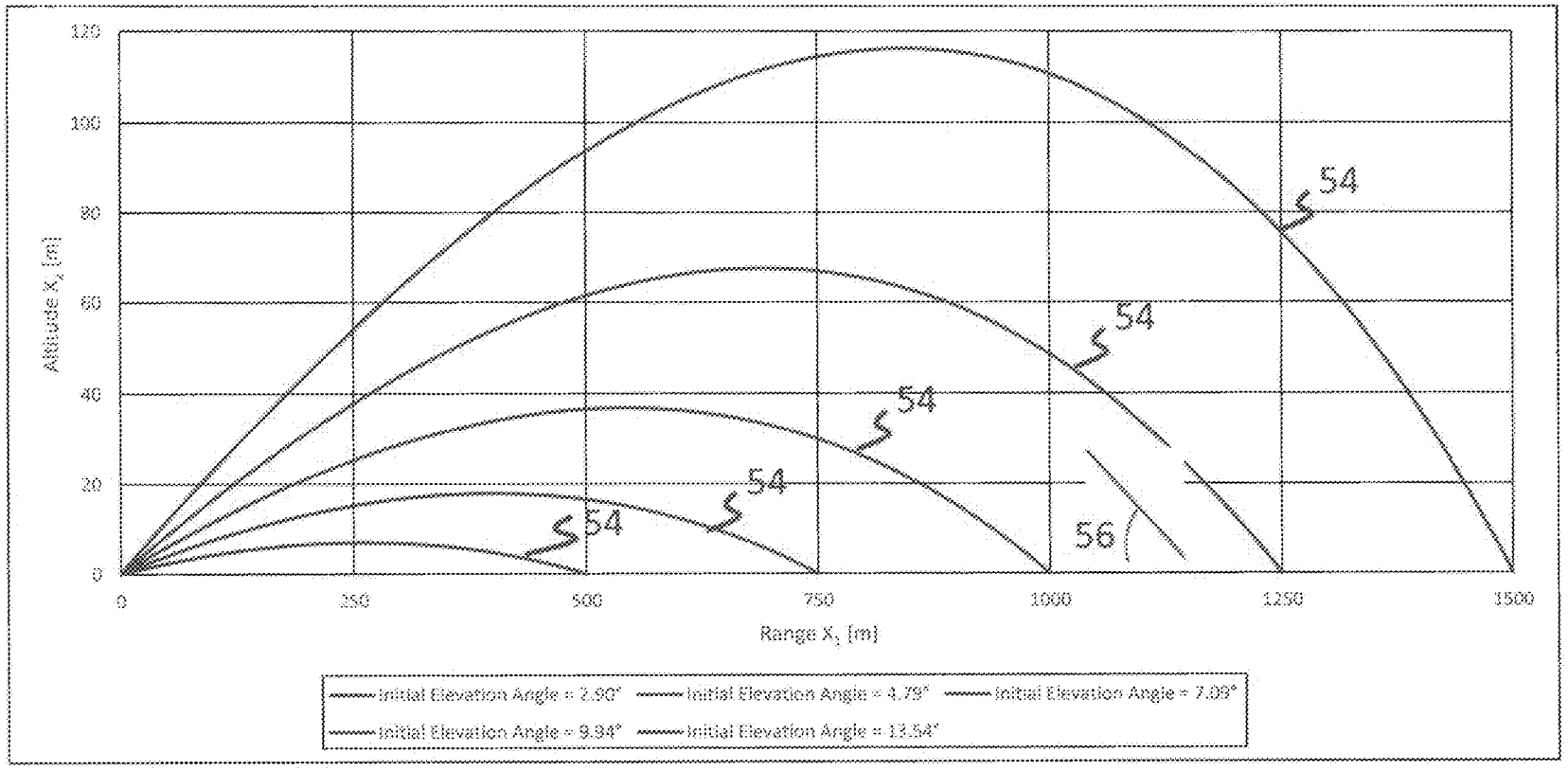

FIG. 9B depicts the trajectory and impact angle of 40 mm×53 projectiles fired from a ground position at ranges for 500-1500 meters. The table below the diagram (altitude versus range) identified the impact angle of the 40 mm projectile.

Projectile Impact, Break Up and Marking Signature:

Impact Geometry and Signature: FIG. 10A-10F illustrate the impact function of the projectile, where translational momentum and inertia (124), coupled with rotational moment and inertia (128) and impact shear forces (130), incident to impact, produce wall compression (66), wall tension (68) and shear forces (130) the cause the frangible body to fracture (76) ejecting the marking material perpendicular to translational (linear momentum and inertia) vector (124) in various impact angles (56), surface angles (58) with various trajectories (52, 54) usable in most training environments.

Figure 10A:
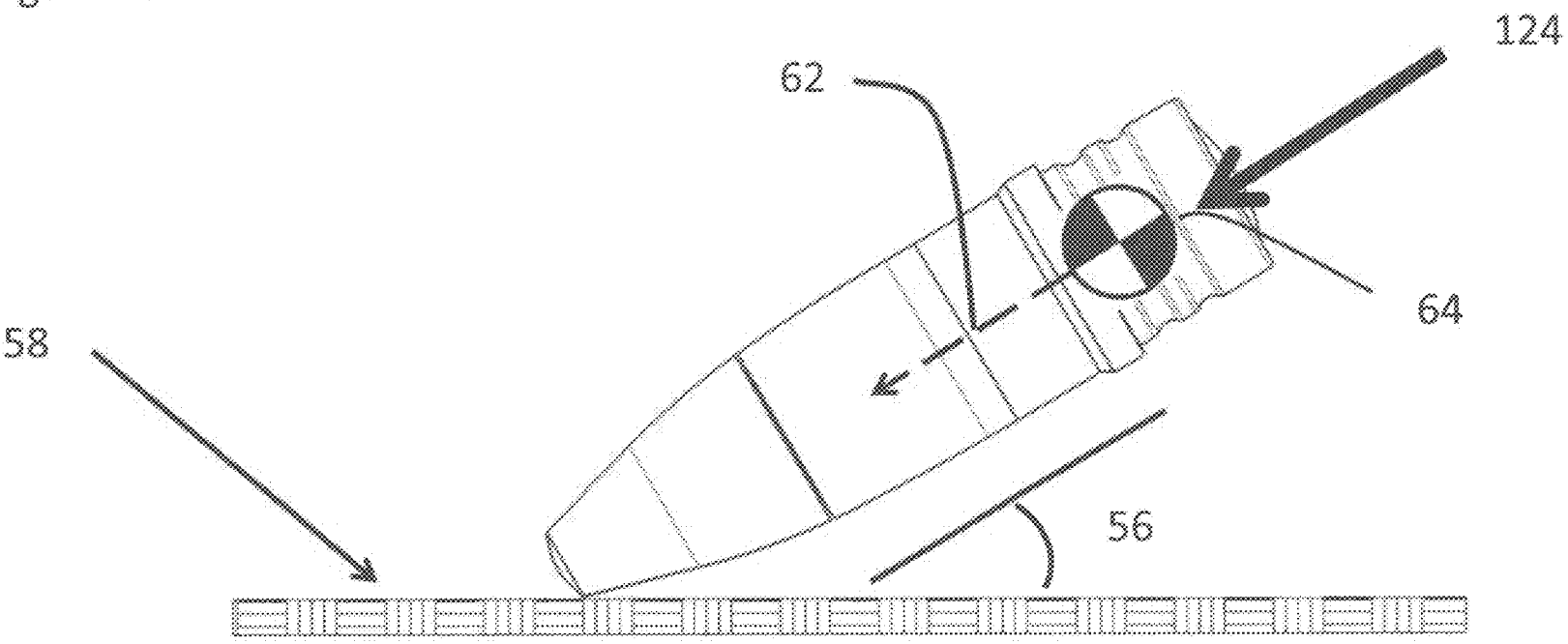

FIG. 10A depicts the impact angle (56) of a 30 mm projectile impacting on a surface (58) with a residual travel vector (62) and the projectile's center of gravity (64), and forward momentum (124) at the moment of impact.

Figure 1A:
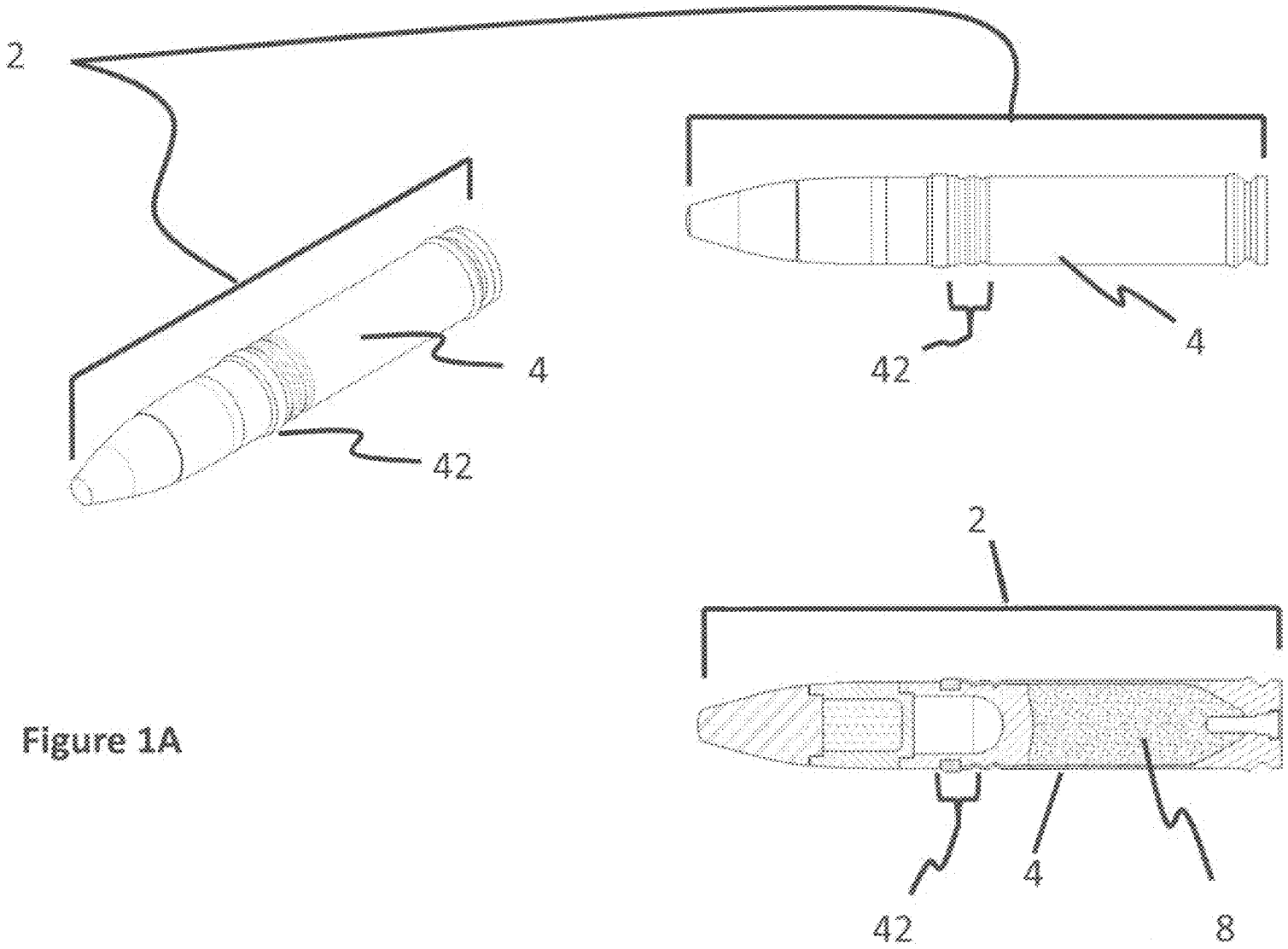
Figure 1B:
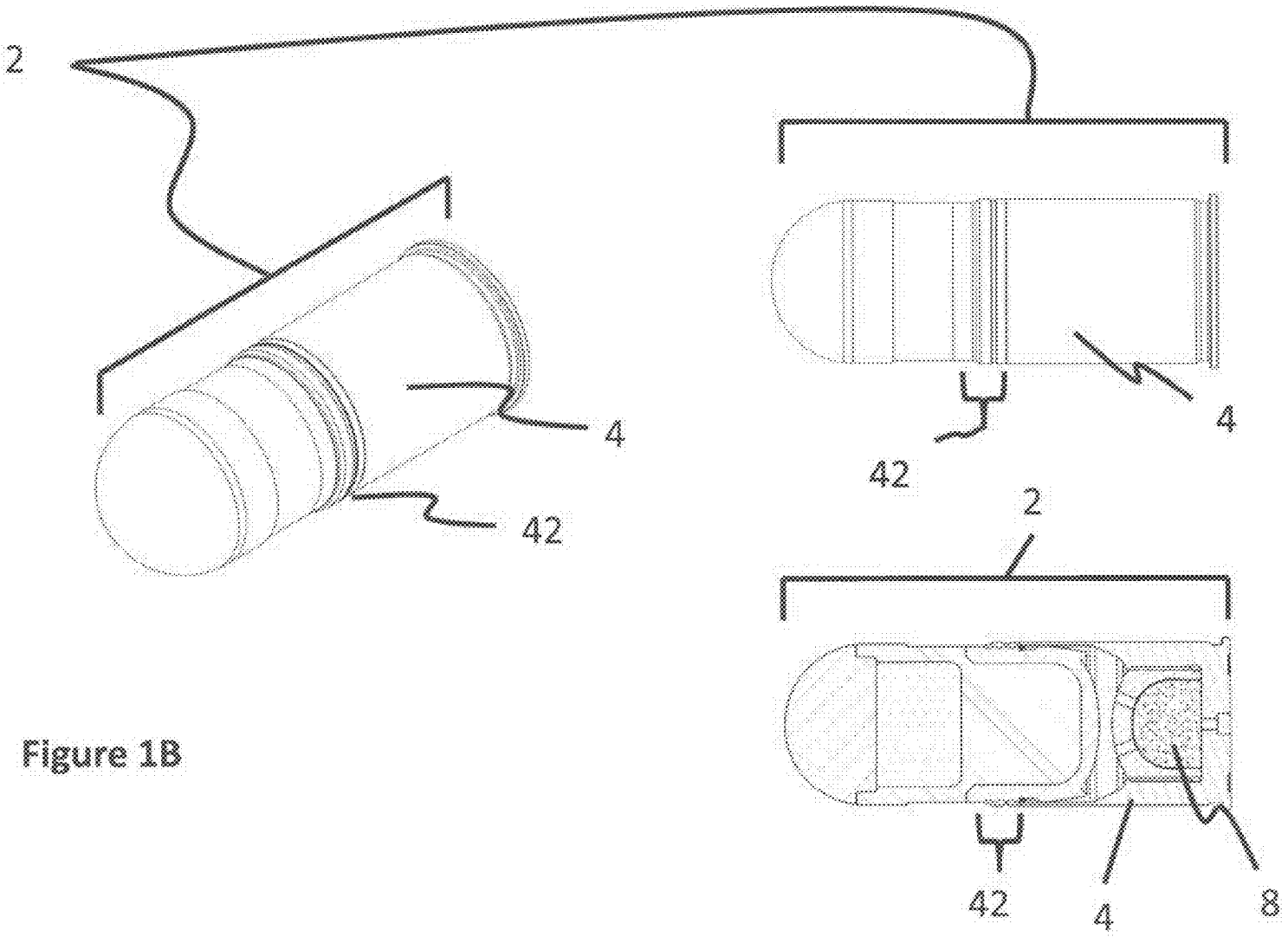
FIG. 1B depicts 40 mm gun fired cartridges (2) with driving bands (42). A cartridge case (4) encloses propellant powder (8).
Figure 1C:
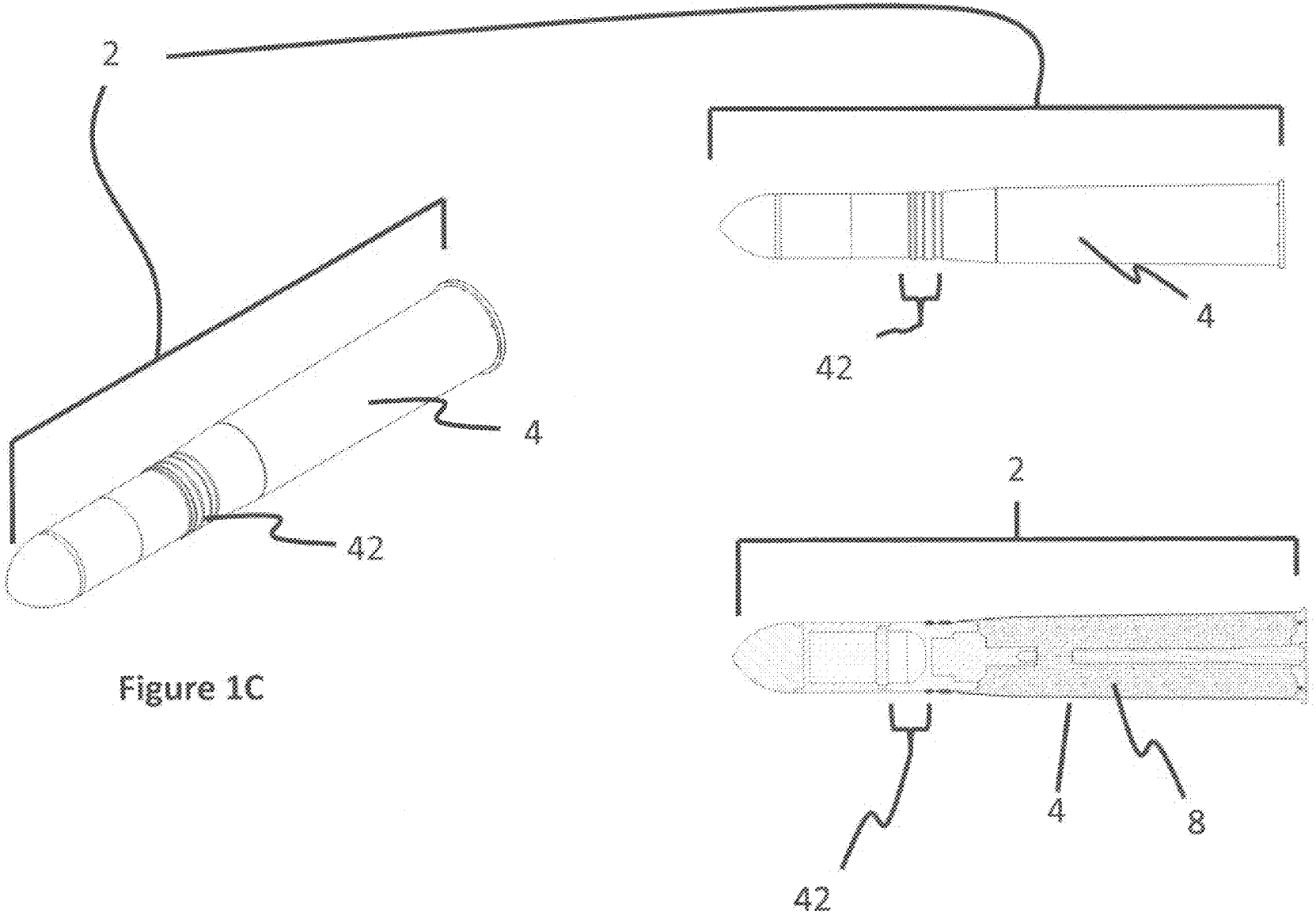
FIG. 1C depicts 105 mm (tank) gun cartridges (2) with driving bands (42). A cartridge case (4) encloses propellant powder (8).
Figure 2A:
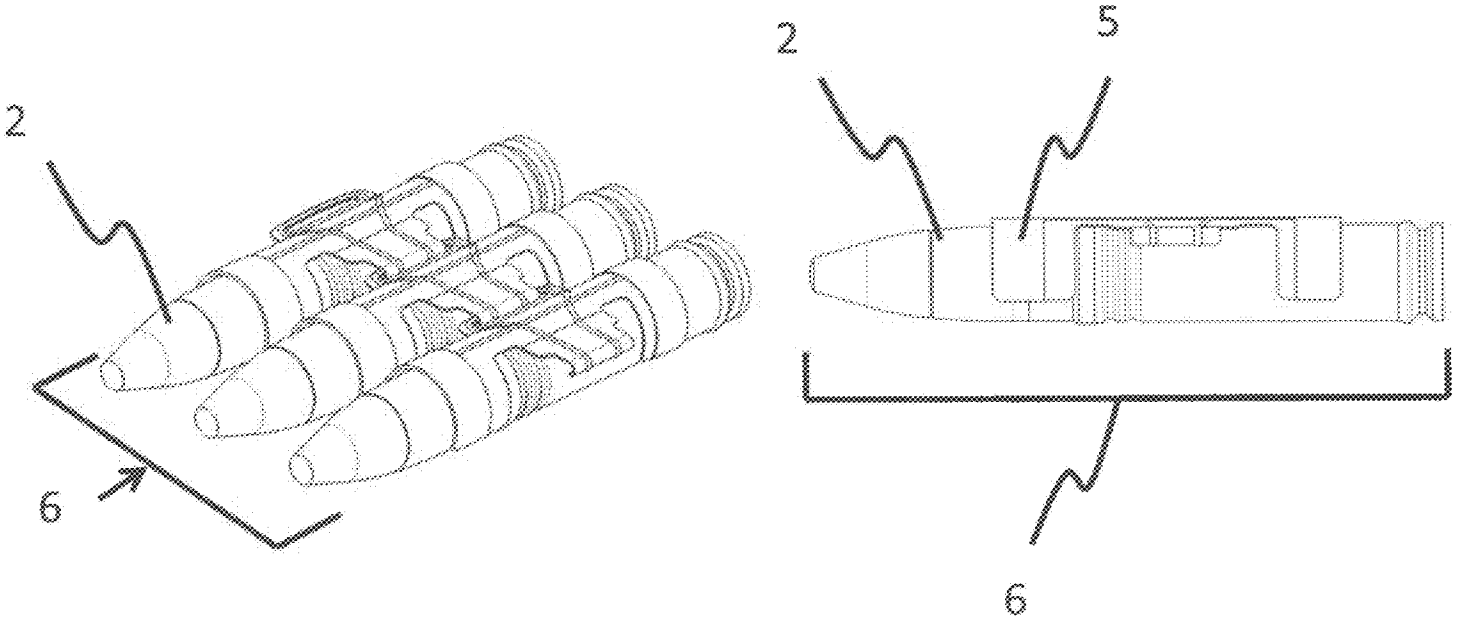
FIG. 2A depict a 30 mm cartridge (2) configured in a belt of ammunition (6).
Figure 2B:
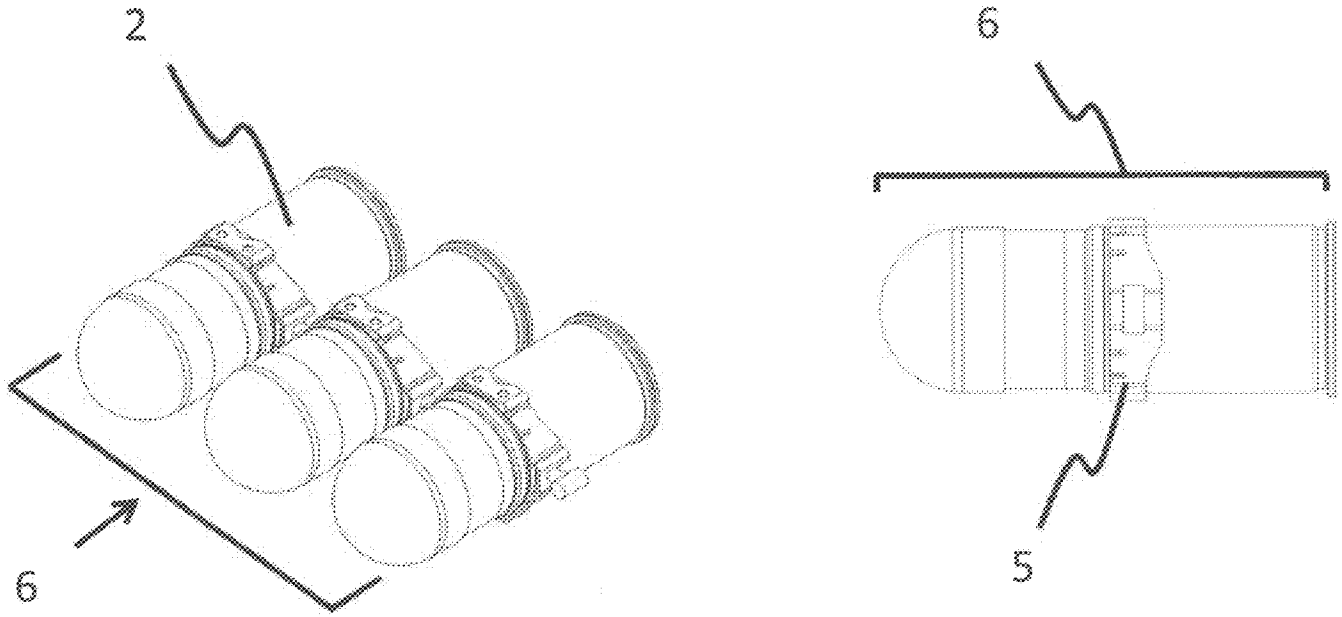
FIG. 2B depict a 40 mm cartridge (2) configured, connected by a link (5), forming a belt of ammunition (6).

FIGS. 10B1 and 10B2 depicts a 30 mm projectile's travel vector (62) when impact on the surface (58) milliseconds after the moment of impact, where the forward momentum (124) creates areas of compression (66) and tension (68) in the projectile's mid body.

Figure 10C:
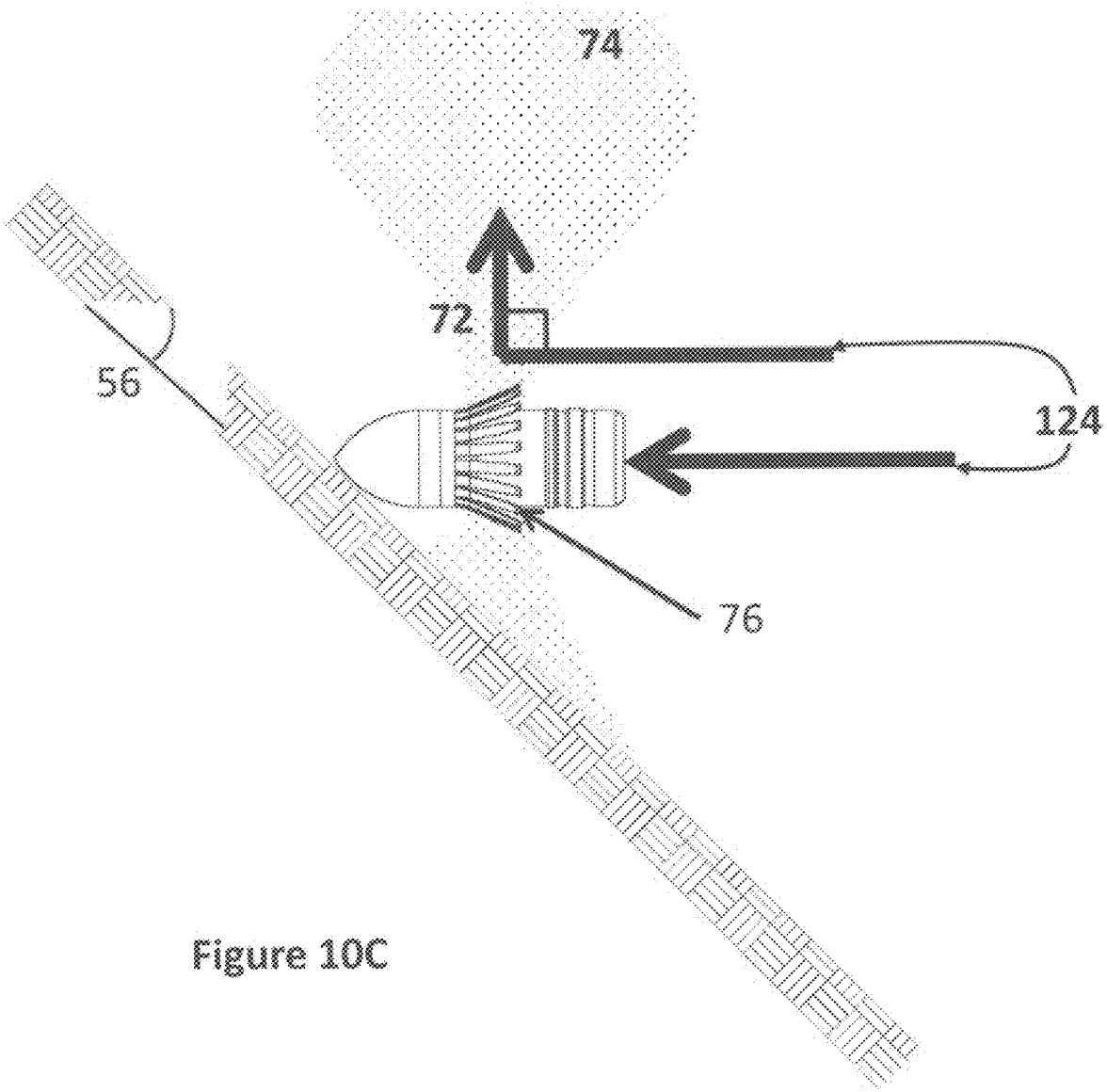

FIG. 10C depict a 105 mm projectile's translational (Linear) Momentum and Inertia Vector (124), milliseconds after impact on an upright angular surface, with an impact angle (56) marking material ejected perpendicular to the translational (Linear) moment and inertia vector (72), decelerating in the atmosphere becoming momentarily suspended in the atmosphere (74).

Figure 10D:
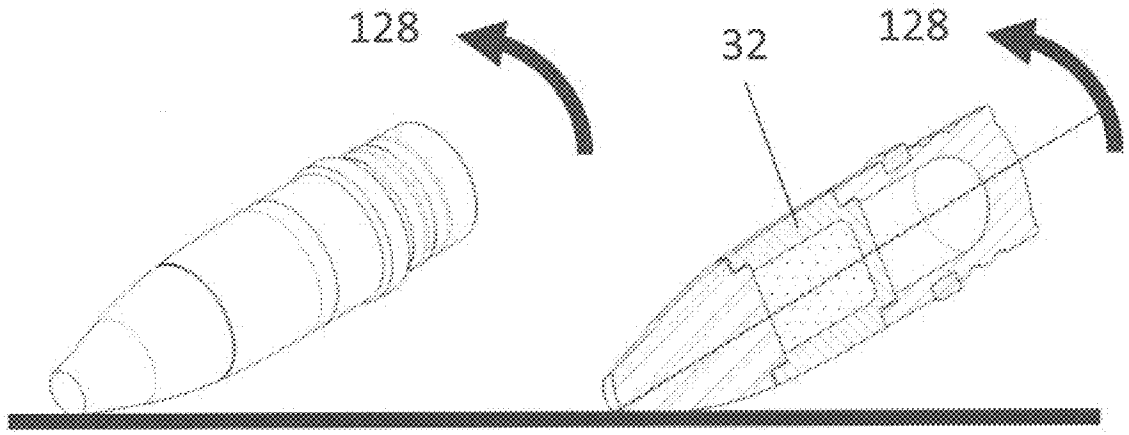

FIG. 10D depicts the body fracture (70) caused when the forward momentum (124) and impact shear force (130) produced by the impact on a surface (58).

Figure 10E:
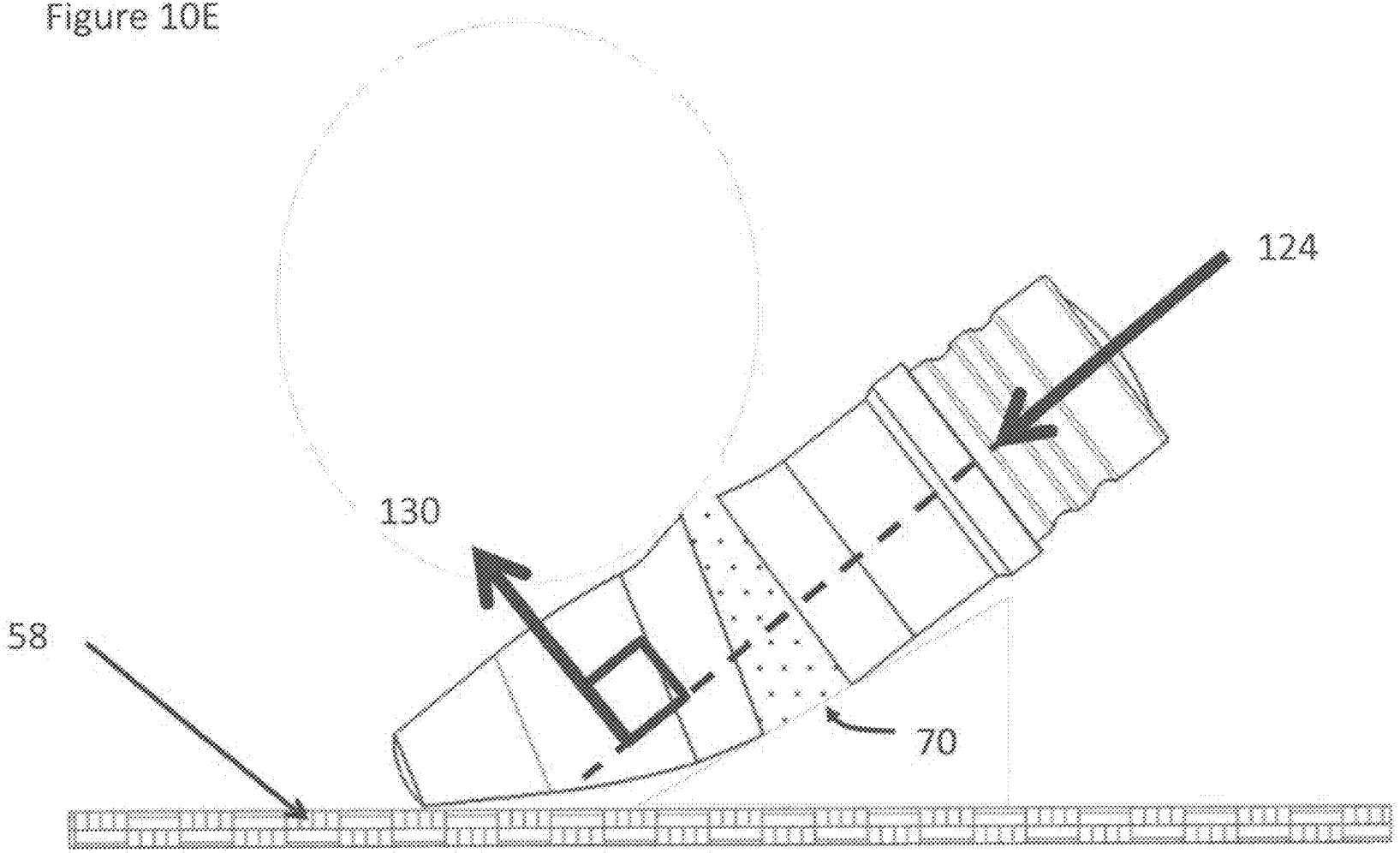
Figure 10F:
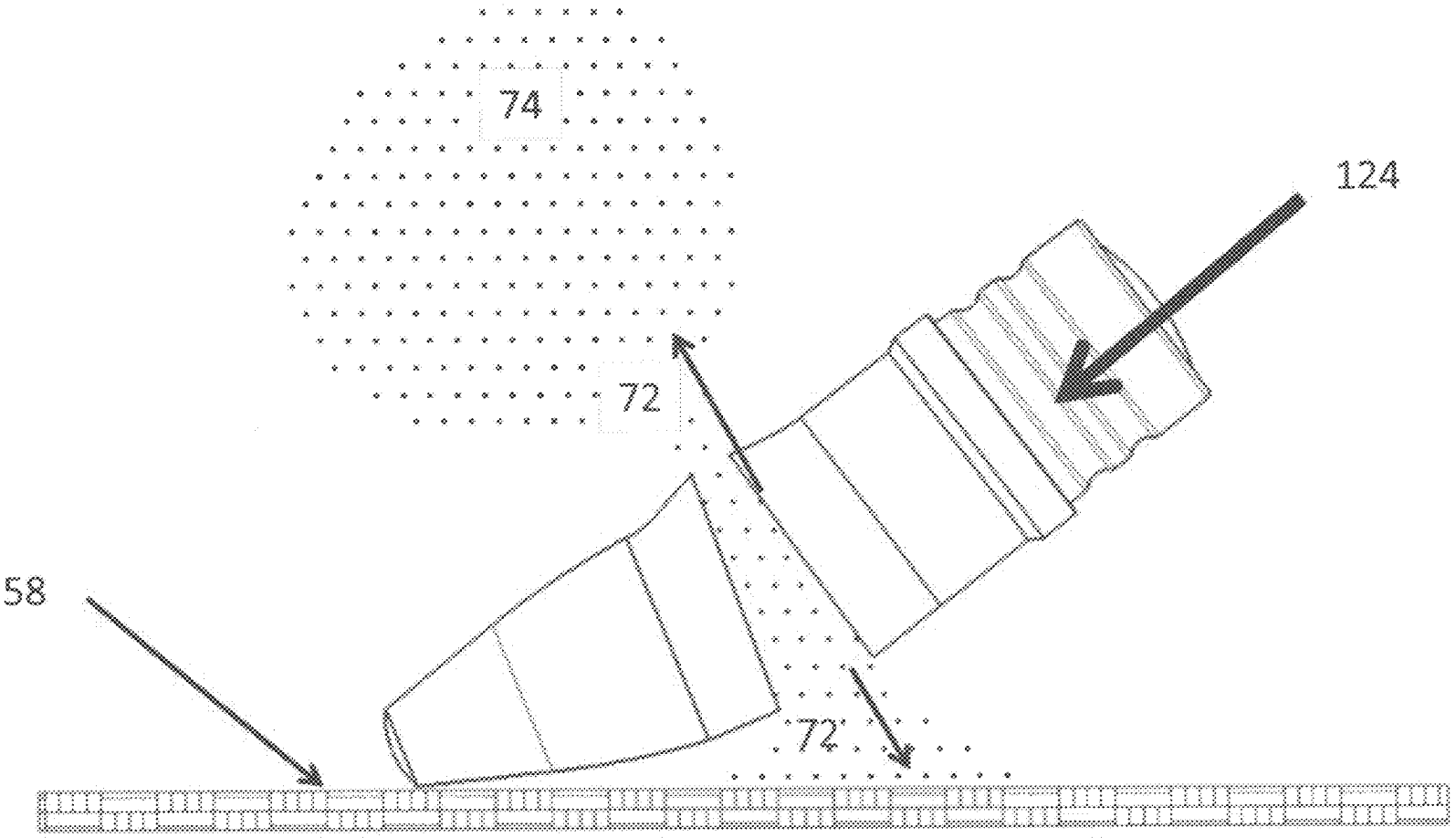

FIG. 10E depicts a 30 mm projectile, at the moment of impact, where rotational inertia (128A) of the base (40), is different than the marking body (30) rotational inertia (128B) and the nose cap's rotational inertia (128C). In combination, the differing inertias at impact, impart torsional loads that tear the mid body marker apart with a twisting action, the broken body wall, with residual rotation, releasing and ejecting marking material (72) into the atmosphere. At the moment of impact, the friction between the surface (58) and the projectile's nose (132) coupled with the residual inertia in each of the projectile's three components (10,20,30) produce torsional loads about the residual axis of rotation (134A,B,C), which, in combination with impact related compression and tension, act to fracture (70) the wall of the marking body (30).

Impact, Frangible Body Break Up and Release of a marking Signature: With continued reference to FIGS. 10A-

10E, when a projectile impacts on the ground or on a target, the impact angle (56) and surface angle (58) geometry coupled with the translational (linear) momentum (124) of the projectile base's mass (40) induce a rotational momentum and inertias (128) and at impact shear forces (130) may also act to induce wall compression (66) and wall tension (68). The forgoing four forces (124, 128 and, 130 act in combination to fracture (70) the mid body' wall. Further compression and residual rotation forces acting further to eject the marking material (72) such that the low-density marking powder, preferably incorporating a high contrasting pigment or dye is released into the atmosphere, air-resistance rapidly de-accelerating becoming momentarily suspended (74) in the vicinity of the impact point.

Figure 11A:
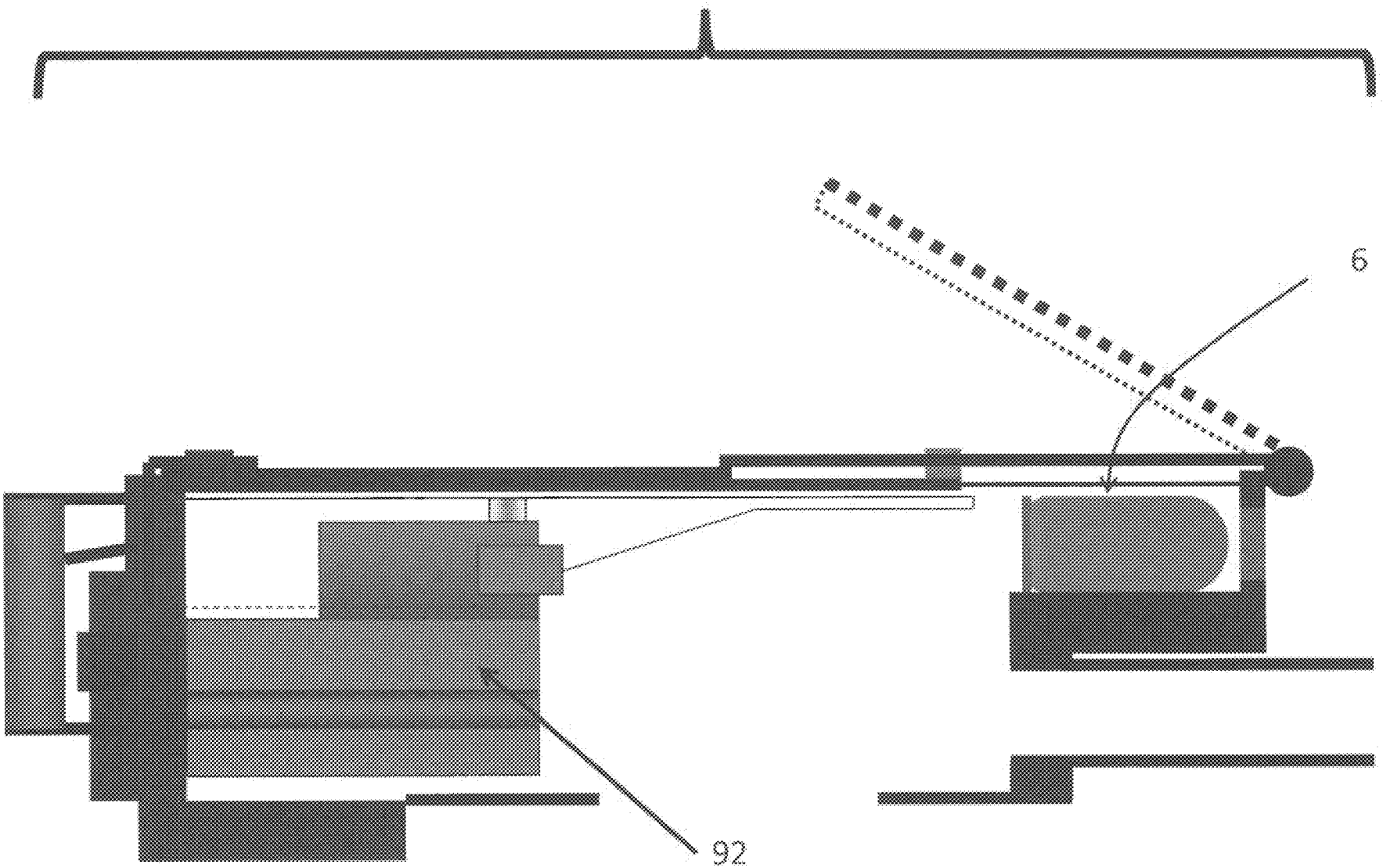
Figure 11B:
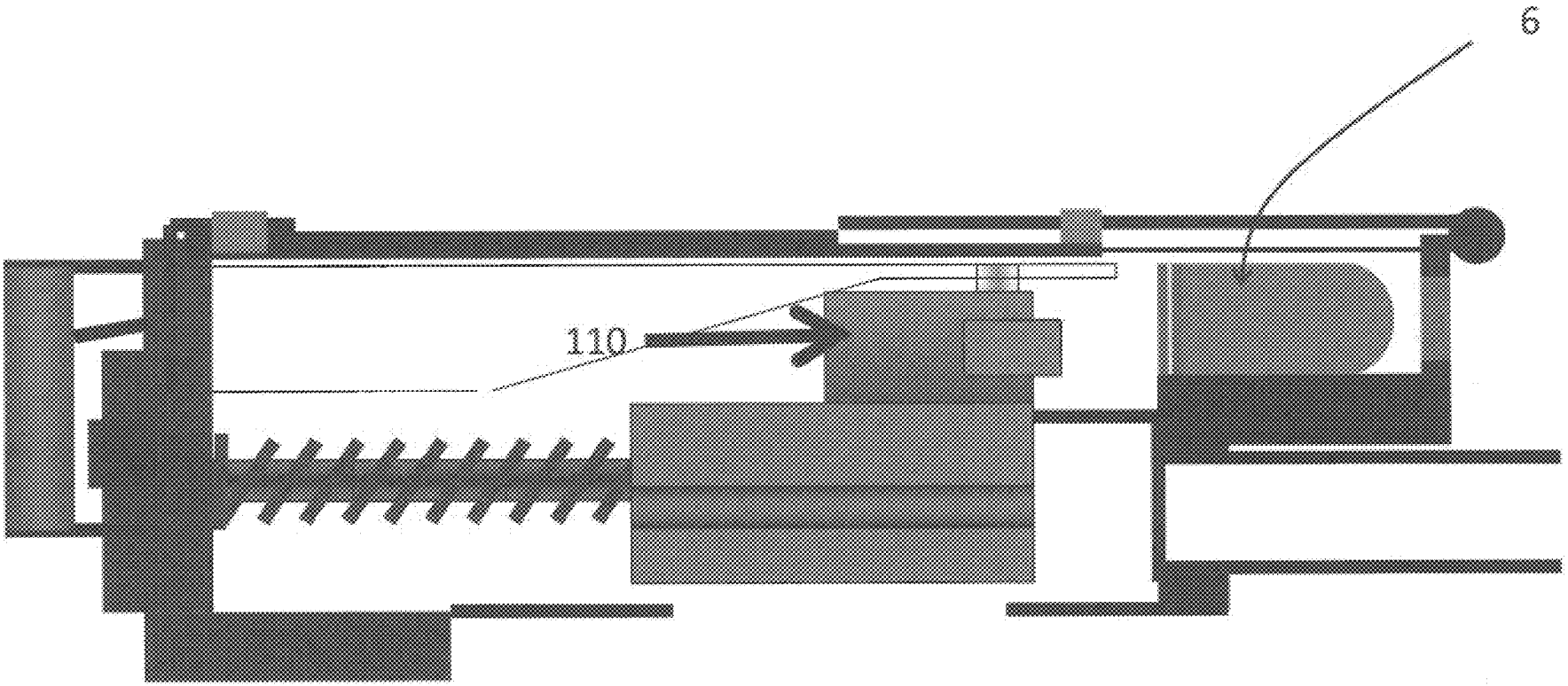
Figure 11C:
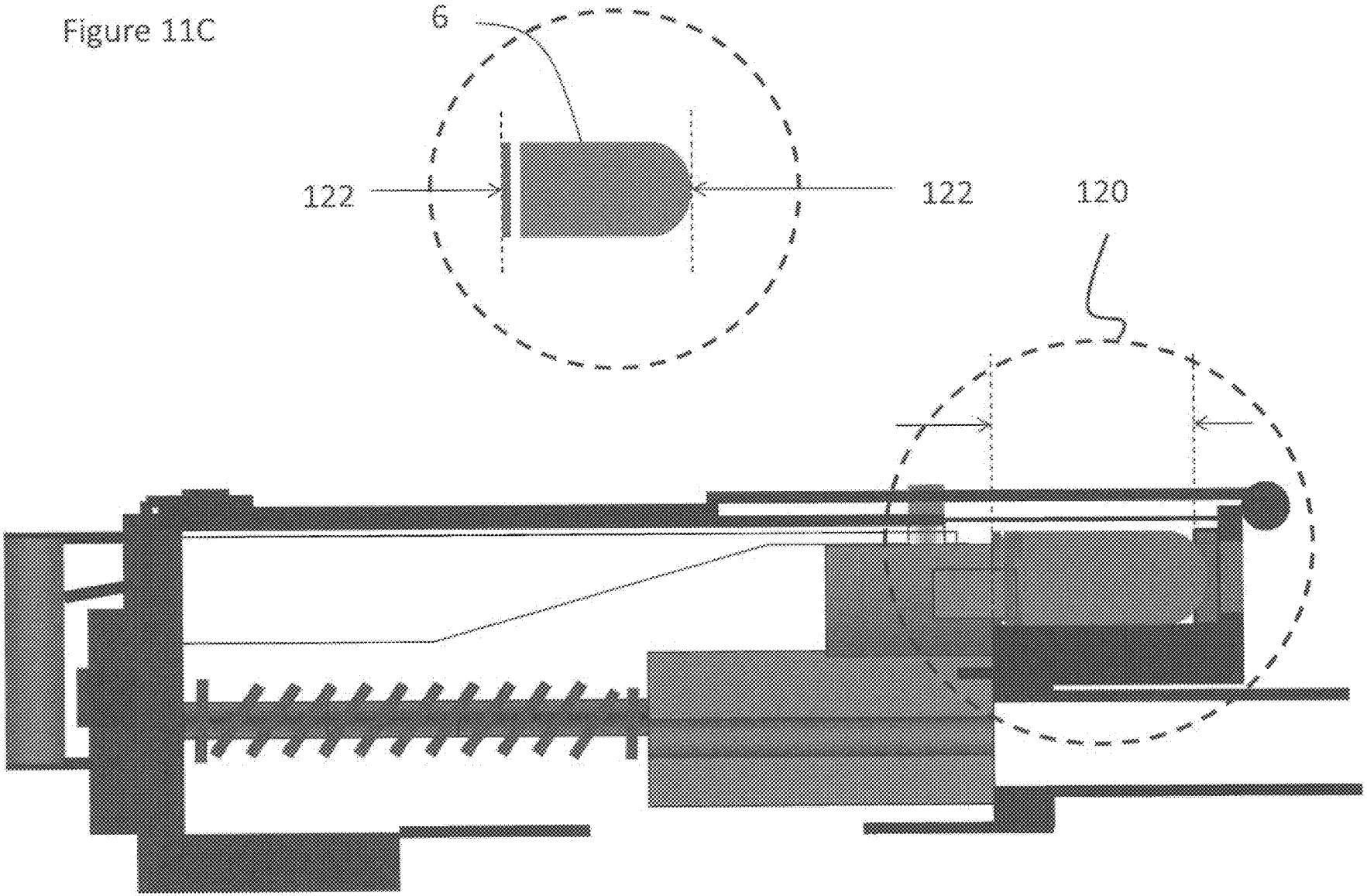
Figure 11D:
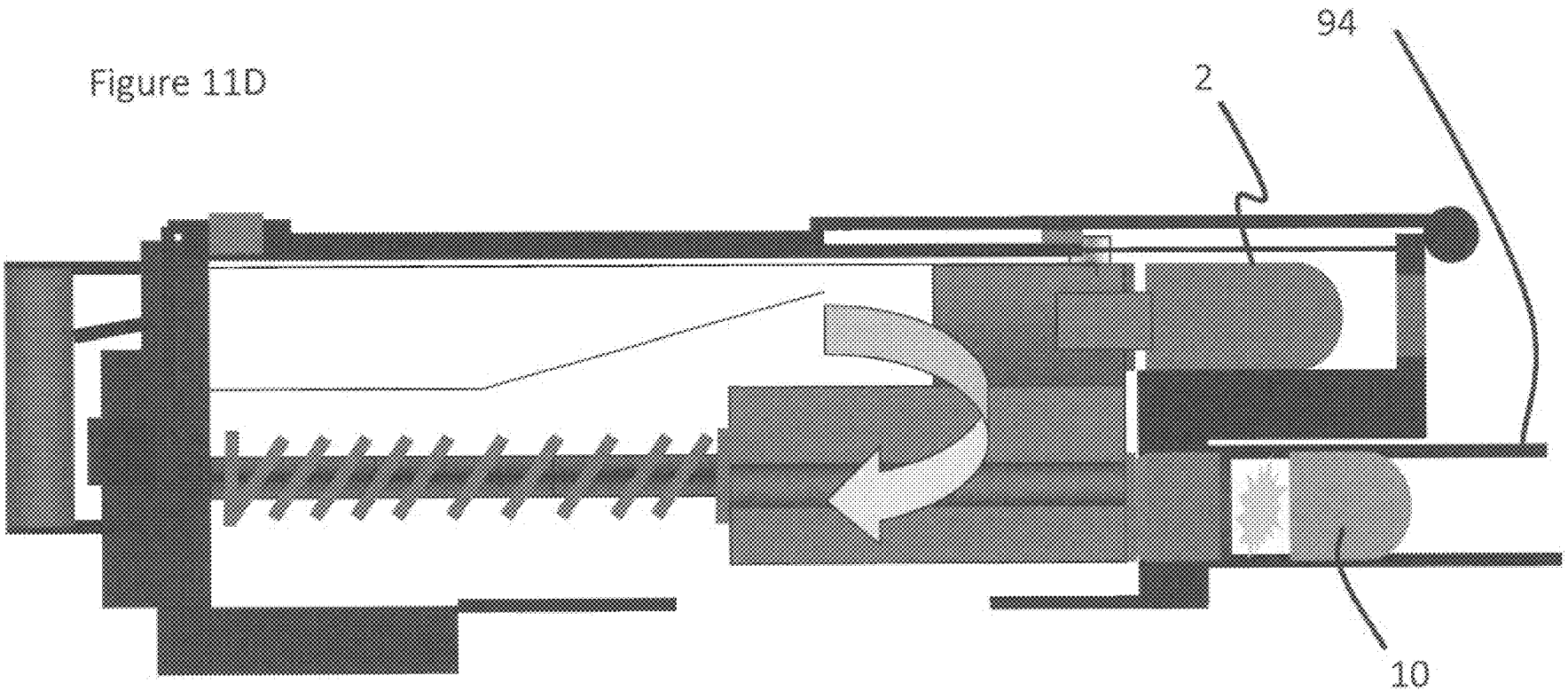
Figure 11E:
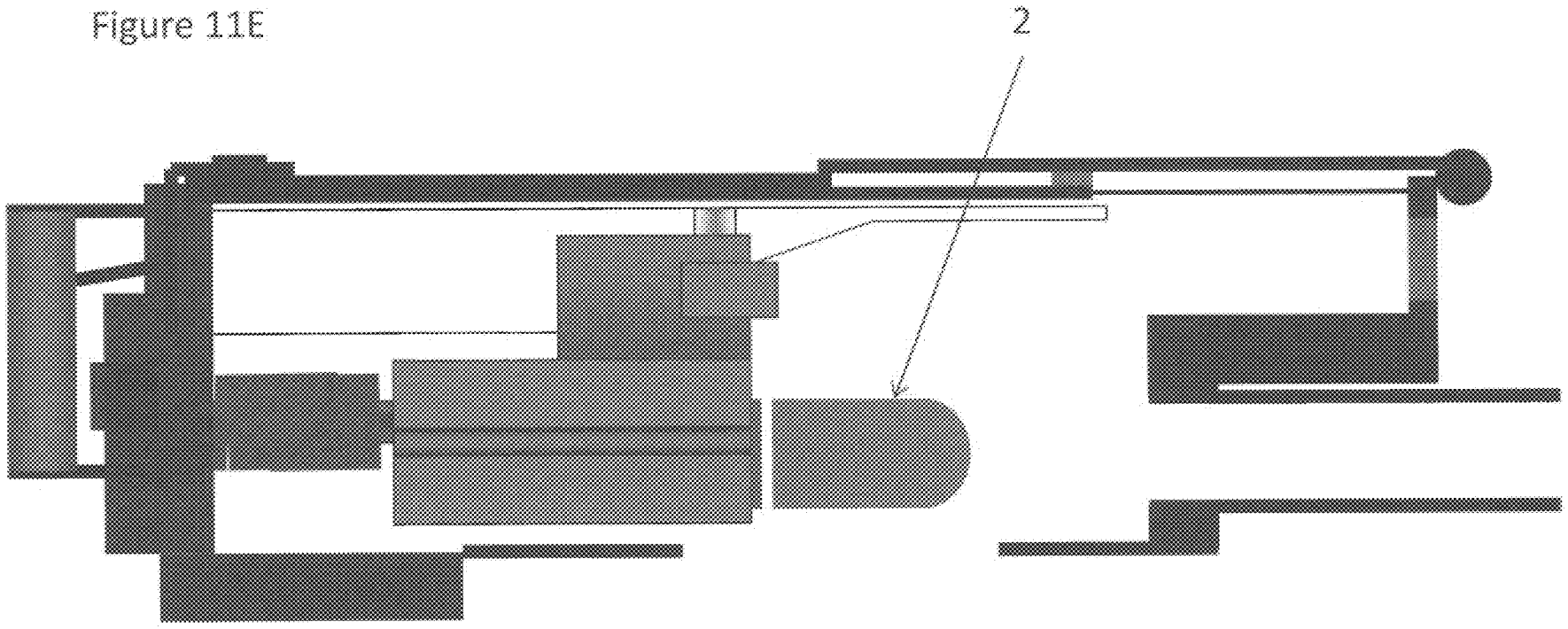
Figure 11F:
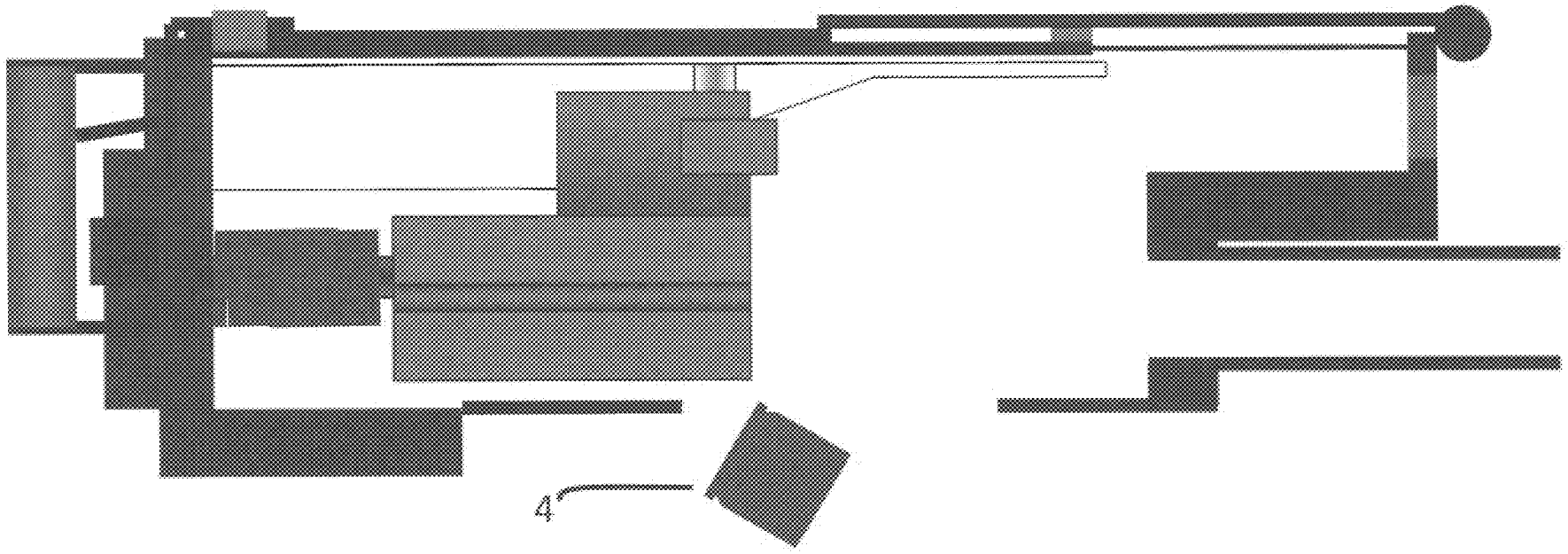

Weapon Feeding and Cartridge Modes of Use: FIG. 11A-F illustrate modes of function fire for a 40 mm cartridge function fired from a MK19 weapon system. FIG. 11A depict the feeding cycle of an open bolt MK19 40 mm AGL. When a liked cartridge (6) loaded into a weapon, a weapon's feeding system, that normally includes a bolt (92) and a barrel (94). As depicted in FIG. 11B, the bolt is released and a compressed spring releases the bolt (110) forward to the closed bolt position depicted in FIG. 11C. In this position, the linked cartridge (6) is in a compressed position (120, 122). The bolt's extractors de-link the cartridge chambering and functioning the cartridge, firing the projectile (1) thru the barrel (94). The process of "feeding" a weapon may include extraction of the cartridge (2) from the linked ammunition belt (6). The process of feeding induces compression (120) and tension (112) requiring the entire cartridge remains intact prior to function fire. At function fire the projectile (10), at cartridge ignition, moves through the barrel (94), and the lands and grooves in the barrel (not depicted) engrave the projectile's driving band (42) inducing rotation of the projectile (10), said projectile (10) remaining assembled acting as a unitary body, with the base (40) inducing rotation on the frangible marking body (30), which in turn, induces spin on the nose (20).

There has thus been shown and described a novel, marking cartridge which fulfills all of the object and advantage sought therefore. Many changes, modifications, variations and other use and applications of the subject invention, will become apparent to those skilled in the art after considering this specification and the accompany drawings which disclose the preferred embodiments thereof. All such changes, modifications, variation and other uses and applications which do not depart from the spirit and scope of the invention are deeded to been covered by the invention which is to be limited only by the claims which follow.

What is claimed is:

1. An ammunition cartridge, incorporating a spin stabilized projectile, said projectile fabricated from three principle components (1) a non-frangible metallic nose having a conical shape including a curved surface and a closed base, (2) a mid-body cylinder fabricated from a frangible material, and (3) substantially solid metallic projectile base with a driving band, wherein the nose, the mid-body cylinder, and the projectile base form a void aft the base of the nose and within the mid-body cylinder, said void housing (4) a marking material, the combination of the nose, the mid-body cylinder, the projectile base, and the marking material forming a complete projectile assembly; wherein the projectile assembly, at impact, encounters shear, compressive and torsion loads causing failure of the frangible mid-body cylinder, whereby wall failure of the mid-body cylinder, coupled with residual forward momentum of the projectile base and residual rotational energy of the projectile base in combination, release, throw and eject said marking material from said void.

2. The ammunition cartridge of claim 1, wherein the mid-body cylinder is fabricated from a polymer.

3. The ammunition cartridge of claim 1, wherein the projectile assembly comprises a structural strength to undergo handling, weapon feeding, set-back and spin-up.

4. The ammunition cartridge of claim 1, wherein the frangible walls of the mid-body cylinder fail when undergoing shear, torsion and compression caused by projectile impact.

5. The ammunition cartridge of claim 1, wherein the marking material is released when the frangible walls fail, the released marking material being ejected into the atmosphere.

6. The ammunition cartridge of claim 5, wherein the marking material uses materials selected to provide an optical signature, detectable by the human eye and electro-optic instruments.

7. The ammunition cartridge of claim 5, wherein the ejected marking material quickly decelerates, becoming momentarily suspended in the atmosphere.

8. The ammunition cartridge of claim 7, wherein the ejected marking material includes a low density marking powder.

9. The ammunition cartridge of claim 8, wherein the ejected marking powder is momentarily suspended in the atmosphere, in the vicinity of the impact.

10. The ammunition cartridge of claim 7, wherein the ejected marking material includes a chemiluminescent compound.

11. The ammunition cartridge of claim 7, wherein the ejected marking material includes a pyrophoric material.

12. The ammunition cartridge of claim 7, wherein the ejected marking material incorporates dyes or pigments that provide a visual contrast to the ambient environment.

13. The ammunition cartridge of claim 1, wherein the nose is fabricated from a solid, inelastic non-frangible material.

14. The ammunition cartridge of claim 1, wherein the frangible, mid body cylinder has a structure configured to shatter on impact.

15. The ammunition cartridge of claim 14, wherein the structure has grooves inducing failure in compression forces, imparted at impact.

16. The ammunition cartridge of claim 14, wherein the structure has grooves inducing failure by torsional forces, imparted at impact.

* * * * *